US012281658B2

(12) United States Patent
Ojima et al.

(10) Patent No.: US 12,281,658 B2
(45) Date of Patent: Apr. 22, 2025

(54) BLOWER

(71) Applicant: MAKITA CORPORATION, Anjo (JP)

(72) Inventors: Akira Ojima, Anjo (JP); Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 18/594,214

(22) Filed: Mar. 4, 2024

(65) Prior Publication Data

US 2024/0200568 A1 Jun. 20, 2024

Related U.S. Application Data

(60) Division of application No. 17/374,689, filed on Jul. 13, 2021, now Pat. No. 11,946,484, which is a (Continued)

(30) Foreign Application Priority Data

Feb. 13, 2019 (JP) ..... 2019-023953
Feb. 13, 2019 (JP) ..... 2019-023956

(51) Int. Cl.
*F04D 29/28* (2006.01)
*F04D 25/06* (2006.01)
(Continued)

(52) U.S. Cl.
CPC ..... *F04D 29/30* (2013.01); *F04D 25/0606* (2013.01); *F04D 25/0673* (2013.01);
(Continued)

(58) Field of Classification Search
None
See application file for complete search history.

(56) References Cited

U.S. PATENT DOCUMENTS 4,859,144 A 8/1989 Houston
9,707,580 B1 * 7/2017 Mancl ..... H02P 25/14
(Continued)

FOREIGN PATENT DOCUMENTS

CN 108071091 A 5/2018
JP S56-104200 A 8/1981
(Continued)

OTHER PUBLICATIONS

Mar. 17, 2020 International Search Report issued in International Patent Application No. PCT/JP2020/003786.
(Continued)

*Primary Examiner* — Sabbir Hasan
(74) *Attorney, Agent, or Firm* — Oliff PLC

(57) ABSTRACT

A blower includes a motor, a plurality of fans coaxially arranged in multiple stages, a housing having an inlet opening and a discharge opening, and a battery mounting part to which a battery is removably mountable. A rotational speed of the motor is within a range of 50,000 rpm to 120,000 rpm. A diameter of each of the fans is within a range of 30 mm to 70 mm. An area of the discharge opening is within a range of not less than an area of a circle having a diameter of 2.5 mm and not more than an area of a circle having a diameter of 10 mm. A blowing force of air discharged through the discharge opening is within a range of 1 N to 3 N.

14 Claims, 11 Drawing Sheets

Related U.S. Application Data continuation-in-part of application No. PCT/JP2020/003786, filed on Jan. 31, 2020.

(51) Int. Cl.
*F04D 25/08* (2006.01)
*F04D 29/30* (2006.01)
*F04D 29/42* (2006.01)

(52) U.S. Cl.
CPC ..... *F04D 25/086* (2013.01); *F04D 29/281* (2013.01); *F04D 29/4226* (2013.01)

(56) References Cited

U.S. PATENT DOCUMENTS

| | | | | |
|---|---|---|---|---|
| 10,837,451 | B2 * | 11/2020 | Yakubova | F04B 39/121 |
| 2012/0076672 | A1 | 3/2012 | Binder | |
| 2018/0140146 | A1 | 5/2018 | Zhu et al. | |

FOREIGN PATENT DOCUMENTS

| | | | | |
|---|---|---|---|---|
| JP | S57-054700 | U | 3/1982 | |
| JP | S57-107999 | U | 7/1982 | |
| JP | S60-105893 | U | 7/1985 | |
| JP | 2011-117442 | A | 6/2011 | |
| WO | WO-2011052560 | A1 * | 5/2011 | B08B 5/02 |

OTHER PUBLICATIONS

Aug. 10, 2021 International Preliminary Report on Patentability issued in International Patent Application No. PCT/JP2020/003786.
Aug. 9, 2022 Office Action in Japanese Patent Application No. 2019-023956.
Dec. 6, 2022 Office Action issued in Japanese Patent Application No. 2019-023956.
Jan. 17, 2023 Office Action issued in Japanese Patent Application No. 2019-023953.

* cited by examiner

BLOWER

CROSS-REFERENCE TO RELATED APPLICATIONS

This application is a divisional of U.S. application Ser. No. 17/374,689 filed Jul. 13, 2021, which is a continuation-in-part of International Application No. PCT/JP2020/003786, filed on Jan. 31, 2020, which claims priority to Japanese Patent Application Nos. 2019-023953, filed on Feb. 13, 2019 and 2019-023956, filed on Feb. 13, 2019. The disclosure of the foregoing applications is hereby incorporated by reference in its entirety.

TECHNICAL FIELD

The present disclosure relates to a blower.

BACKGROUND

A known blower is capable of blowing off grit, dust, etc. by discharging air through a nozzle. Such a blower may be generally called as an air duster. Air dusters include a pneumatic air duster (also referred to as an air gun or air blow gun) that uses compressed air that is supplied from a compressor via a hose, and an electric air duster that uses air that is blown by a fan (impeller) that is driven by an electric motor. For example, Japanese Unexamined Patent Application Publication No. 2011-117442 discloses an electric air duster that is configured to discharge compressed air, using five-stage centrifugal fans rotated by a motor, which is powered by a battery serving as a power source.

SUMMARY

One or more exemplary embodiments of the present disclosure provide a blower that includes a motor, a plurality of fans, a housing and a battery mounting part. The fans are coaxially arranged in multiple stages and configured to compress and blow air by rotating around a specified rotational axis when the motor is driven. The housing houses the motor and the fans. The housing has an inlet opening through which the air is sucked into the housing and a discharge opening through which the air compressed and blown by the fans is discharged. A battery for supplying power to the motor is removably mountable to the battery mounting part. A rotational speed of the motor is within a range of 50,000 rpm to 120,000 rpm. A diameter of each of the fans is within a range of 30 mm to 70 mm. An area of the discharge opening is within a range of not less than an area of a circle having a diameter of 2.5 mm and not more than an area of a circle having a diameter of 10 mm. A blowing force of air discharged from the discharge opening is within a range of 1 N to 3 N.

One or more exemplary embodiments of the present disclosure also provide a blower that includes a motor, a fan, a housing and a battery mounting part. The fan is configured to blow air by rotating around a specified rotational axis when the motor is driven. The housing houses the motor and the fan. The housing has an inlet opening through which the air is sucked into the housing and a discharge opening through which the air blown by the fans is discharged. A battery for supplying power to the motor is removably mountable to the battery mounting part. A rotational speed of the motor is within a range of 50,000 rpm to 120,000 rpm. A diameter of the fan is within a range of 30 mm to 70 mm. A blowing force of the air discharged through the discharge opening is within a range of 1 N to 3 N.

It is noted that in a case where the rotational speed of the motor can be set steplessly or in multiple steps, it is herein sufficient that at least any settable rotational speed is within the above-described range. It is further noted that the blowing force herein is measured in accordance with the "ANSI B175.2 standard" specified by American National Standards Institute (ANSI).

DESCRIPTION OF EMBODIMENTS

An air duster 1 according to an embodiment of the present disclosure is described below with reference to the drawings. The air duster 1 shown in FIG. 1 is a kind of blower that is capable of blowing off grit, dust etc., by discharging air through an discharge opening 203, and is configured as a handheld electric tool to be used while held by a user.

First, the general structure of the air duster 1 is described.

Figure 1:
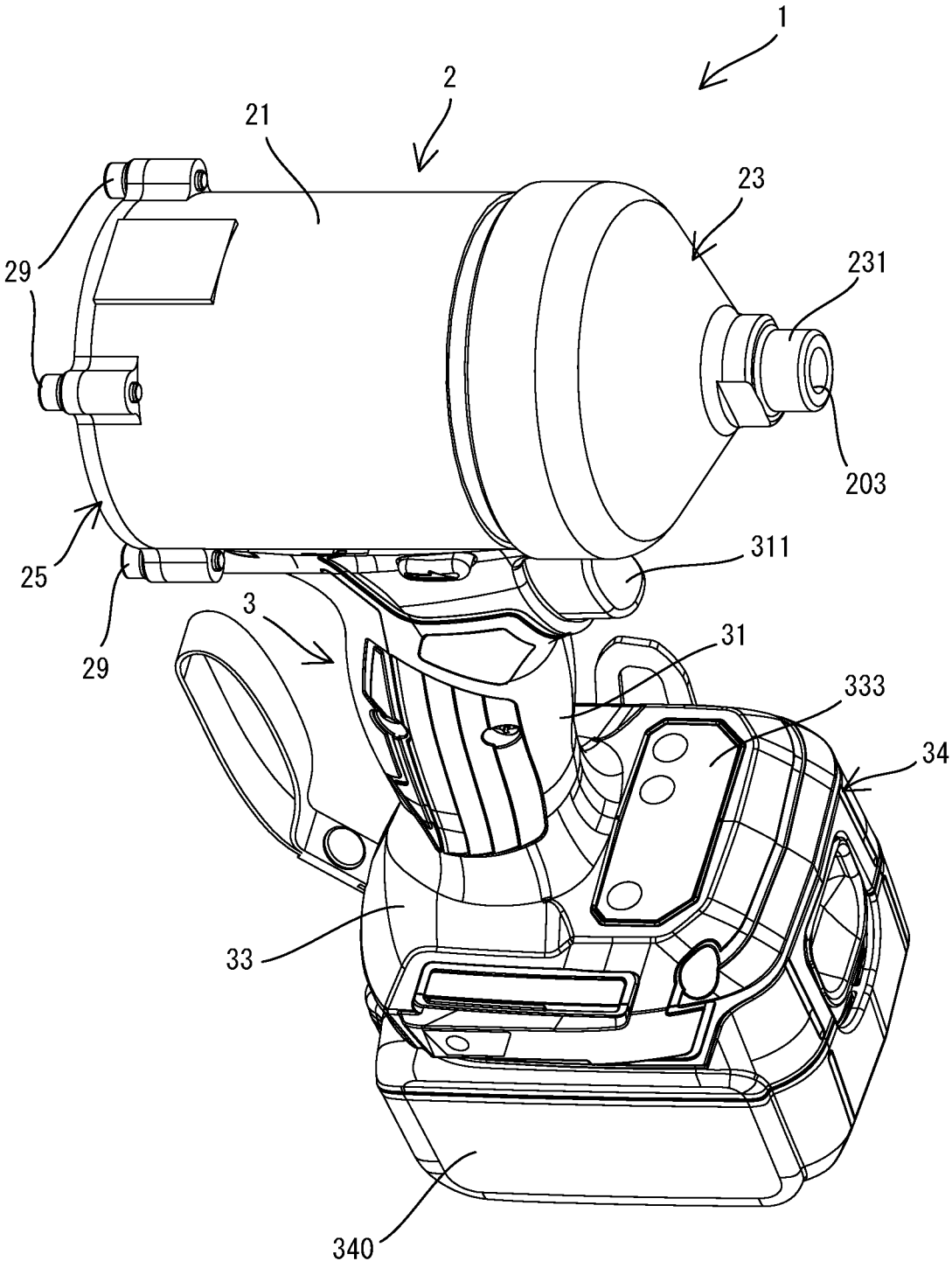
FIG. 1 is a perspective view of an air duster.
Figure 2:
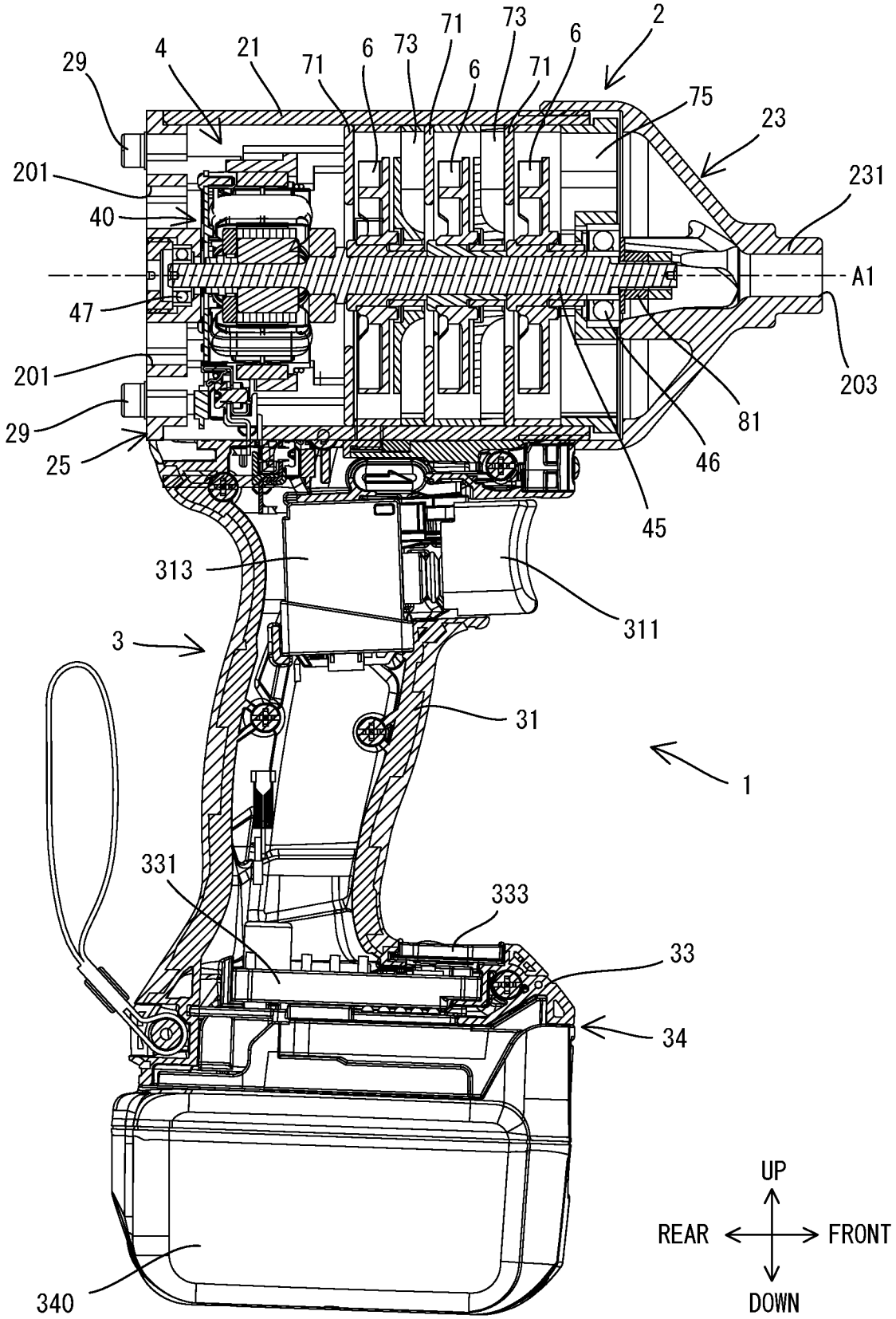
FIG. 2 is a sectional view of the air duster.

As shown in FIGS. 1 and 2, an outer shell of the air duster 1 is mainly formed by a body housing 2 and a handle 3. The body housing 2 is configured as a hollow body for housing a motor 4 and a plurality of fans (also referred to as impellers) 6. In this embodiment, the body housing 2 has a generally hollow cylindrical shape and has the discharge opening 203 at one end in its axial direction. The handle 3 is configured to be held by the user and protrudes from the body housing 2 in a direction that crosses (that is generally orthogonal to) an axis of the body housing 2. A trigger 311 is provided in a base end portion (an end portion connected to the body housing 2) of the handle 3 and configured to be depressed by the user. Further, a battery 340 is removably coupled to a protruding end portion of the handle 3 via a battery mounting part 34. When the trigger 311 is depressed by the user, the motor 4 is energized and the fans 6 are driven, and thereby compressed air is discharged through the discharge opening 203.

The structure of the air duster 1 is now described in detail. In the following description, for convenience sake, the axial direction of the body housing 2 (which is also the direction of a rotational axis A1 of a motor shaft 45 and the fans 6 described below (hereinafter referred to as a rotational-axis-A1 direction)) is defined as a front-rear direction of the air duster 1. In the front-rear direction, the side on which the discharge opening 203 is located is defined as a front side, while the opposite side is defined as a rear side. A direction that is orthogonal to the axis of the body housing 2 (the rotational axis A1) and that corresponds to the extension direction of the handle 3 is defined as an up-down direction. In the up-down direction, the base end side of the handle 3 is defined as an upper side, and the protruding end side (the side on which the battery 340 is removably mounted) is defined as a lower side. A direction that is orthogonal to both the front-rear direction and the up-down direction is defined as a left-right direction.

The handle 3 and elements disposed within the handle 3 are now described.

As shown in FIGS. 1 and 2, the handle 3 is configured as a hollow body that includes a tubular grip part 31 and a controller-housing part 33. The grip part 31 is a tubular portion extending generally in the up-down direction. The controller-housing part 33 is a rectangular box-like portion that is connected to a lower end of the grip part 31 and that forms a lower end portion of the handle 3. An upper end portion of the handle 3 (the grip part 31) is fixed to the body housing 2 by screws, so that the handle 3 is integrated with the body housing 2.

The grip part 31 is a portion to be held by the user when the air duster 1 is used (operated). The trigger 311 is provided in a front upper end portion of the grip part 31. A switch 313 is housed within the grip part 31. The switch 313 is normally kept OFF and turned ON in response to depressing of the trigger 311. The switch 313 is connected to a controller 331 described below via wiring (not shown). The switch 313 is configured to output to the controller 331 a signal corresponding to a manipulation amount (depressed amount) of the trigger 311 when the switch 313 is turned ON.

The controller-housing part 33 houses a controller 331 that is configured to control various operations of the air duster 1, including driving of the motor 4. In this embodiment, the controller 331 is configured as a microcomputer that includes a CPU, a ROM, a RAM and a memory. The controller 331 is mounted on a main board and housed in a case, and in this state, disposed within the controller-housing part 33. In this embodiment, the controller 331 is configured to control the rotational speed of the motor 4 according to the signal that is outputted from the switch 313 (i.e., according to the manipulation amount of the trigger 311). The maximum rotational speed of the motor 4, which corresponds to the maximum manipulation amount of the trigger 311, is 63,000 rotations per minute (rpm).

Further, a manipulation part 333, which is configured to be externally manipulated by the user, is provided on an upper portion of the controller-housing part 33. The manipulation part 333 has push buttons for accepting various information inputs. The manipulation part 333 is connected to the controller 331 via wiring (not shown) and configured to output to the controller 331 a signal indicating the input information.

The battery mounting part 34 is provided in a lower end portion of the controller-housing part 33. The battery mounting part 34 includes an engagement structure for sliding engagement with the rechargeable battery 340, and terminals that are connectable to terminals of the battery 340 when the engagement structure is engaged with the battery 340. The structures of the battery mounting part 34 and the battery 340 themselves are well known and therefore not described herein.

The body housing 2 and elements disposed within the body housing 2 are now described.

As shown in FIGS. 1 and 2, most of the body housing 2 has a hollow circular cylindrical shape and a front end portion of the body housing 2 has a tapered funnel (conical) shape. A cylindrical front end portion of this funnel shaped portion is referred to as a nozzle 231. An opening of the nozzle 231 defines the discharge opening 203, through which the air compressed within the body housing 2 is discharged outside of the body housing 2. In this embodiment, the discharge opening 203 is circular. The diameter of the discharge opening 203 (also referred to as a nozzle diameter) is 6 millimeters (mm). The discharge opening 203 is located on the rotational axis A1. Although not shown in detail, a hollow cylindrical attachment, which has an inner diameter that is larger or smaller than the nozzle diameter, can be removably attached to the nozzle 231. When the attachment is attached to the nozzle 231, the air that is discharged through the discharge opening 203 passes through the attachment and is then discharged through an opening at a front end of the attachment. Further, a plurality of through holes are formed in a rear wall that defines a rear end portion of the body housing 2. Each of the through holes defines an inlet opening 201, through which the air is sucked in from the outside of the body housing 2.

In this embodiment, the body housing 2 mainly includes a tubular part 21, a front cover 23 and a rear cover 25 that are connected to the tubular part 21. The body housing 2 is formed of synthetic resin (polymer, plastic).

Figure 3:
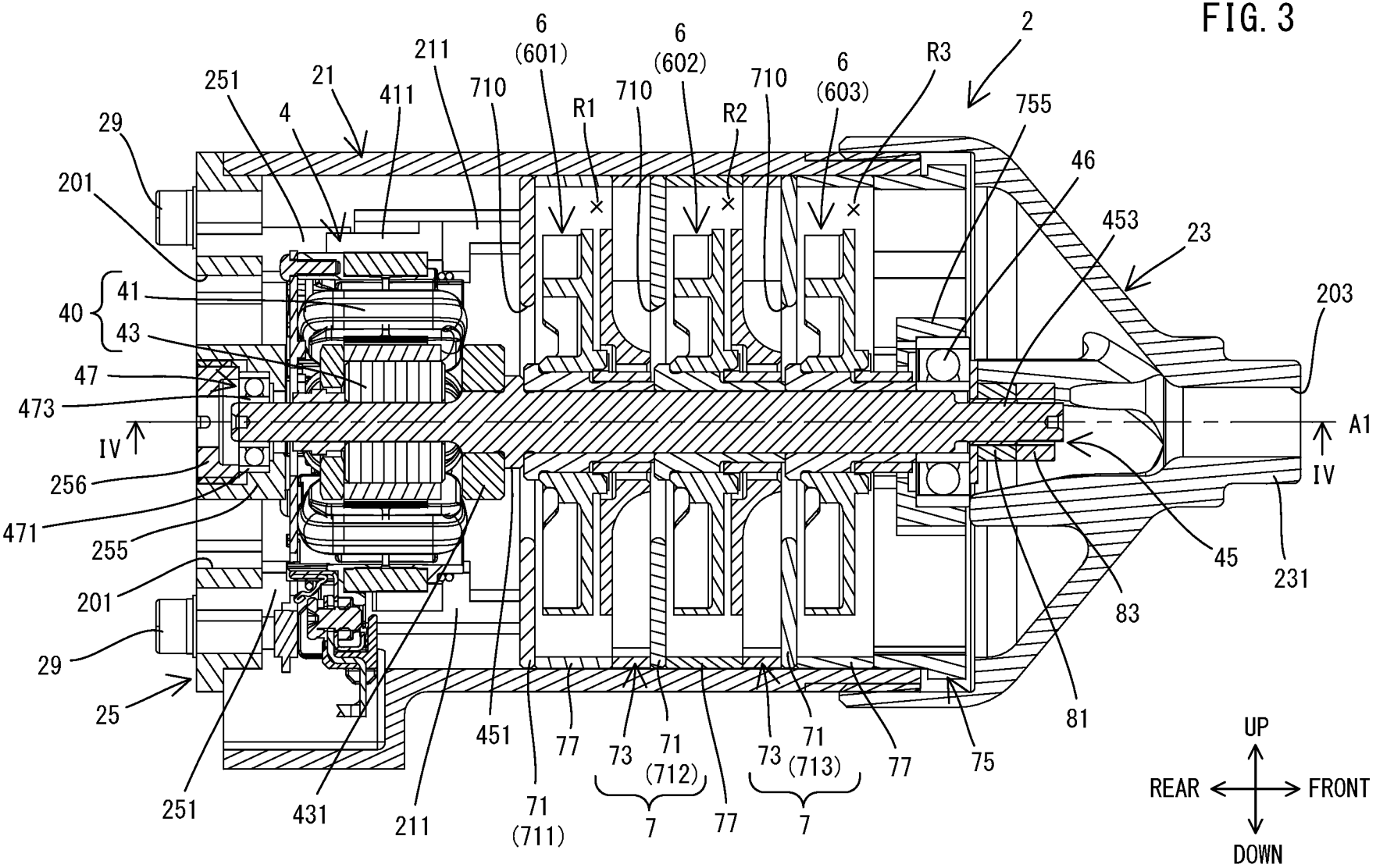
FIG. 3 is a partial, enlarged view of a body housing of FIG. 2.
Figure 4:
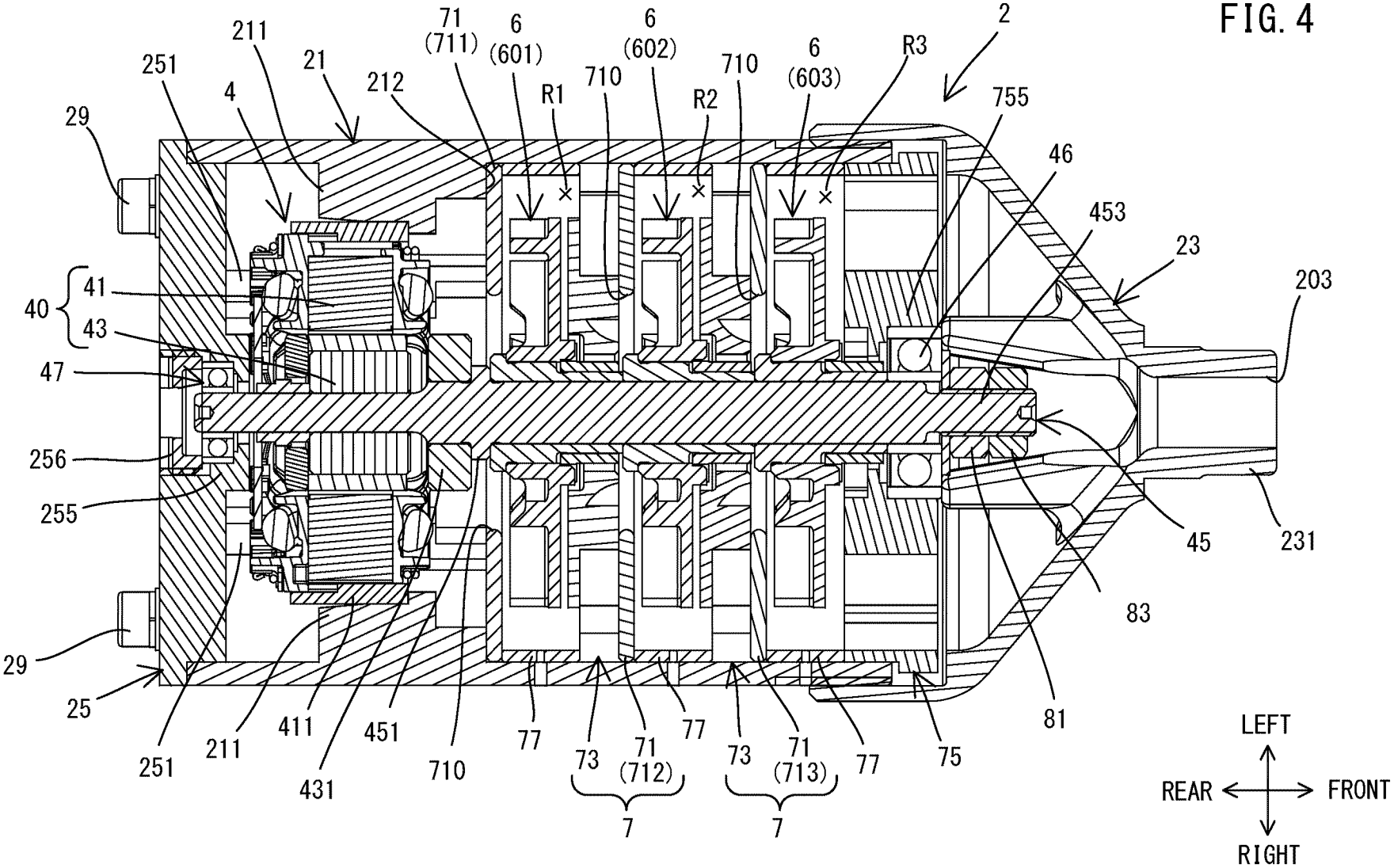
FIG. 4 is a sectional view taken along line IV-IV in FIG. 3.

The tubular part 21 is a generally circular cylindrical member. As shown in FIGS. 3 and 4, a plurality of ribs 211 protrude inward (toward a center axis) from an inner peripheral surface of a rear portion of the tubular part 21. A front end surface 212 of each rib 211 functions as a positioning surface for positioning a first partition plate 711 and thus a partitioning structure 7 (which are described below) in the front-rear direction. The front cover 23 is a funnel-shaped member that covers a front end opening of the tubular part 21. The front cover 23 includes the nozzle 231 and forms a front end portion of the body housing 2. The rear cover 25 is a member that has a circular shape when viewed from the rear and covers a rear end opening of the tubular part 21. The rear cover 25 forms the rear wall of the body housing 2 and has the inlet openings 201 in the form of through holes. Further, the rear cover 25 has a plurality of ribs 251 protruding forward. The ribs 251 are configured to support a stator 41 of the motor 4 together with the ribs 211 of the tubular part 21.

Further, the rear cover 25 is configured as a member for holding a bearing 47 and has a bearing-holding part 255 in its central portion. The bearing-holding part 255 is a bottomed cylindrical portion having a rear end opening. The bearing-holding part 255 has a bottom wall (front wall) having a through hole and a cylindrical peripheral wall. The bearing 47 is fitted in the bearing-holding part 255. The bearing 47 is fastened to the rear cover 25 by a retainer 256, with an outer ring 471 of the bearing 47 in abutment with the bottom wall of the bearing-holding part 255. The retainer 256 is threadedly engaged with a female thread, which is formed in an inner peripheral surface of the peripheral wall of the bearing-holding part 255, from behind the bearing 47.

As described above, the motor 4 and the fans 6 are housed within the body housing 2. More specifically, as shown in FIGS. 3 and 4, a body 40 of the motor 4 is disposed within a rear portion of the body housing 2, and the fans 6 are disposed in front of the motor body 40. Thus, the motor 4 is located between the inlet openings 201 and the fans 6 (on an upstream side of the fans 6) in flow passages of the air that extend from the inlet openings 201 to the discharge opening 203 within the body housing 2.

In this embodiment, a brushless motor is employed as the motor 4. The motor 4 has the body 40 including the stator 41 and a rotor 43, and a motor shaft 45 that extends from the rotor 43 and rotates together with the rotor 43.

The stator 41 is housed in a cylindrical case 411 and held within a rear end portion of the body housing 2. More specifically, the case 411 of the stator 41 is held and supported between the ribs 211 of the tubular part 21 and the ribs 251 of the rear cover 25.

The motor shaft 45 extends in the front-rear direction along the axis of the body housing 2. The motor shaft 45 of this embodiment is much longer than the body 40 and extends from the front end portion to the rear end portion of the body housing 2. The motor shaft 45 is supported by bearings 46, 47 so as to be rotatable around the rotational axis A1 relative to the body housing 2. In this embodiment, each of the bearings 46, 47 is a ball bearing having an outer ring (outer race), an inner ring (inner race) and balls that serve as rolling elements. The bearing 46 that supports a front end portion of the motor shaft 45 is held by the body housing 2 via a flow-guide member 75 described below. The bearing 47 that supports a rear end portion of the motor shaft 45 is held by the bearing-holding part 255 of the rear cover 25 described above.

The rotor 43 is fixed around the rear end portion of the motor shaft 45 and disposed inside of the stator 41 in front of the rear bearing 47. Further, a balance ring 431 is fitted around the motor shaft 45 in front of the rotor 43. The balance ring 431 is formed of a cuttable material (e.g. copper) and can be cut as necessary to optimize the dynamic balance during rotation of the rotor 43. The motor shaft 45 has a flange 451, which protrudes radially outward in front of the balance ring 431. A front end portion of the motor shaft 45 is configured as a male thread part 453 having a thread in its outer peripheral surface. Three fans 6 described below are mounted onto a portion of the motor shaft 45 between the male thread part 453 and the flange 451 (this portion is hereinafter referred to as a fan-mounting part 455). The fan-mounting part 455 has a uniform diameter that is larger than the male thread part 453.

In this embodiment, as shown in FIGS. 3 and 4, the air duster 1 includes three fans 6 having the same structure. The fans 6 are coaxially arranged on the motor shaft 45 and configured to rotate together with the motor shaft 45 around the rotational axis A1 when the motor 4 is driven. Each of the fans 6 is a centrifugal fan that sucks air in the rotational-axis-A1 direction and blows (pushes, delivers) the air radially outward. The fans 6 are respectively disposed in three partitioned space regions (chambers). The fans 6 are hereinafter also referred to as a first fan 601, a second fan 602 and a third fan 603 in order from the first stage side (from the inlet opening 201 side, or the most upstream side in the direction of air flow within the body housing 2, which is the rear end side in the body housing 2 in this embodiment) in order to distinguish them. The regions (chambers) corresponding to the first, second and third fans 601, 602, 603 are also respectively referred to as a first region R1, a second region R2 and a third region R3.

Partitioning within the body housing 2 is now described. As shown in FIGS. 3 and 4, three circular partition plates 71 each having a through hole in its center are disposed within the body housing 2. The three partition plates 71 are respectively disposed behind (that is, on the former stage side or on the suction side of) the three fans 6. The partition plate 71 disposed behind the first fan 601 defines a boundary between a space region in which the motor 4 is disposed (hereinafter referred to as a motor region) and a space region in which the fans 6 are disposed (hereinafter referred to as a fan region). The partition plate 71 arranged behind the second fan 602 defines a boundary between the first region R1 and the second region R2. The partition plate 71 arranged behind the third fan 603 defines a boundary between the second region R2 and the third region R3. The partition plates 71 are hereinafter also referred to as a first partition plate 711, a second partition plate 712 and a third partition plate 713 in order from the first stage, in order to distinguish them. The outer diameter of the partition plate 71 is generally equal to the inner diameter of the body housing 2 (the tubular part 21). The through hole in the center of the partition plate 71 is located on the rotational axis A1 and forms a communication hole 710 that provides communication between regions on the former stage side (rear side) and the next stage side (front side) of the partition plate 7.

In each of the first and second regions R1, R2, a flow-guide member 73 is provided in front (on the next stage side or the discharge opening 203 side) of the fan 6. The flow-guide member 73 is configured to direct the air, which has been pushed out by the fan 6, radially inward, and to lead the air toward the next stage. The two flow-guide members 73 have the same structure. In the third region R3, a flow-guide member 75 is provided in front of the fan 6. The flow-guide member 75 is configured to direct the air, which has been pushed out radially outward by the fan 6, radially inward, and lead the air toward the discharge opening 203. Thus, in this embodiment, the flow-guide member 73 or 75 for guiding the air flow in a specific direction is provided for the fan 6 of each stage.

The fans 6 are assembled onto the motor shaft 45, and the partition plates 71 and the flow-guide members 73, 75 are assembled to the body housing 2. In this embodiment, the three fans 6 are assembled onto the motor shaft 45 using the bearing 46, while the partition plates 71 and the flow-guide members 73, 75 are assembled integrally with spacers 77 disposed therebetween to the body housing 2 using the bearing 46, as will be described in detail below.

Figure 5:
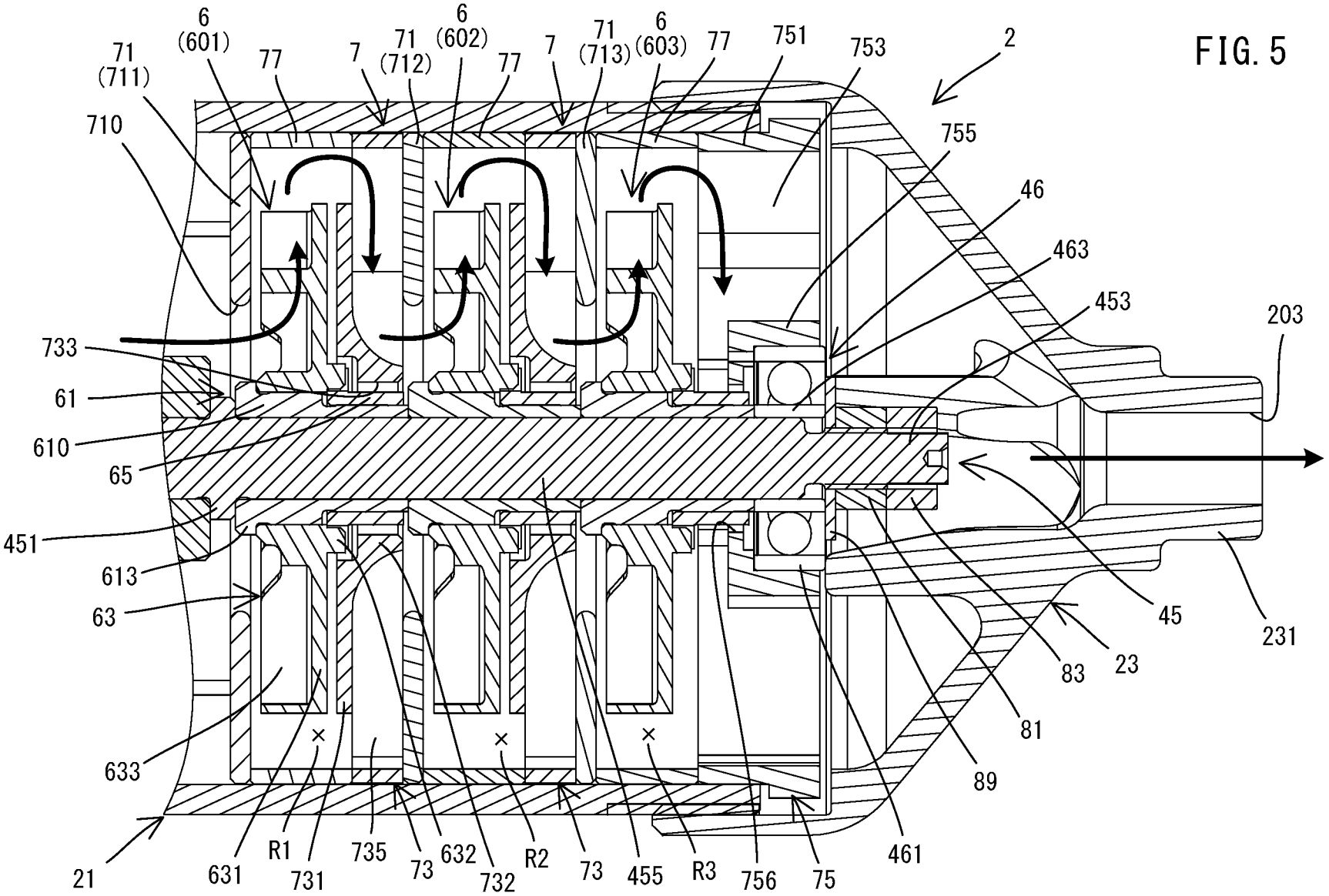
FIG. 5 is a partial, enlarged view of FIG. 3.
Figure 6:
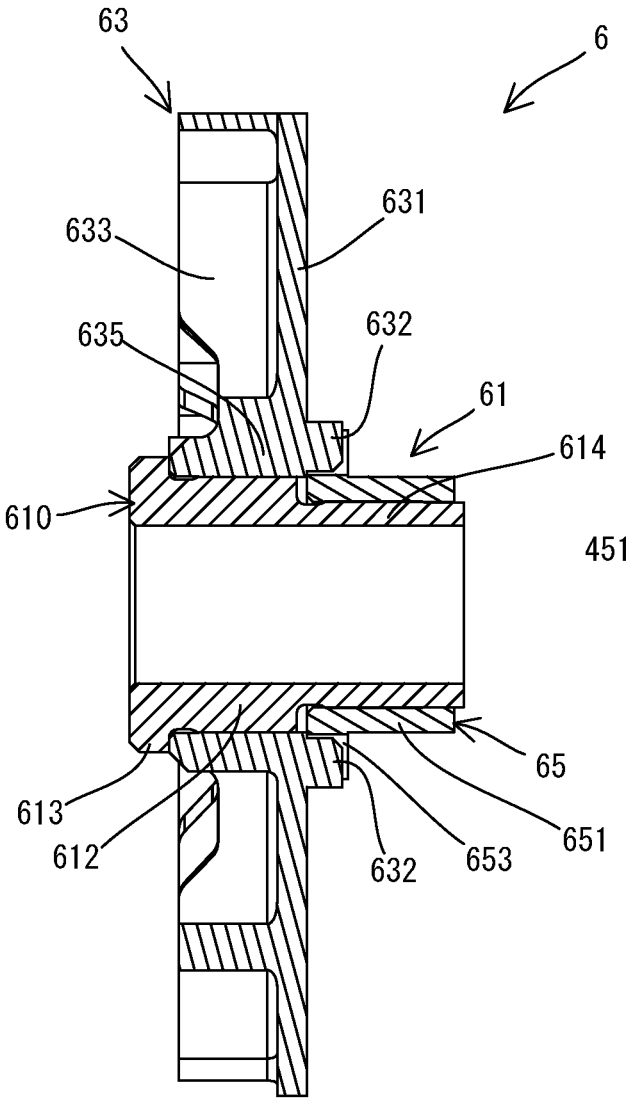
FIG. 6 is a sectional view of a fan.

The structure of the fan 6 is now described in detail. The fan 6 is a centrifugal fan as described above. As shown in FIGS. 5 and 6, the fan 6 is a so-called open impeller including a hub 61, a back plate 631 and a plurality of vanes (blades) 633.

The hub 61 is a tubular portion having a through hole through which the motor shaft 45 is inserted. The back plate 631 is a disc-like portion protruding radially outward from the hub 61. The back plate 631 of this embodiment is flat and has substantially uniform thickness. Each of the vanes 633 protrudes rearward from a rear surface of the back plate 631 on the inlet opening 201 side (the suction side). A gap between the vane 633 of the fan 6 and the partition 71 behind (on the suction side of) the vane 633 is minimized to prevent the air that has been pushed radially outward from flowing back into the gap. The vane 633 radially extends in a curved shape from an outer periphery of the hub 61 (specifically, a boss 635 described below) to an outer edge of the back plate 631. The air that is sucked in the rotational-axis-A1 direction flows radially outward through flow passages that are each defined by the back plate 631 and the adjacent vanes 633 (these flow passages are hereinafter referred to as fan flow passages). The air then flows out of the fan flow passages through openings (outlet openings) defined between radially outer ends of the vanes 633.

Figure 7:
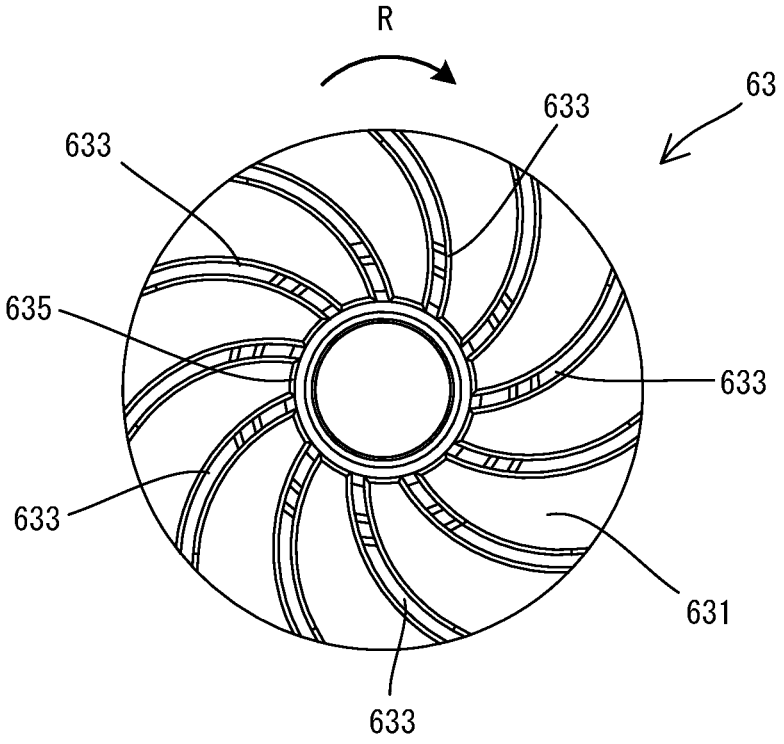
FIG. 7 is a rear view of a body of the fan.
Figure 8:
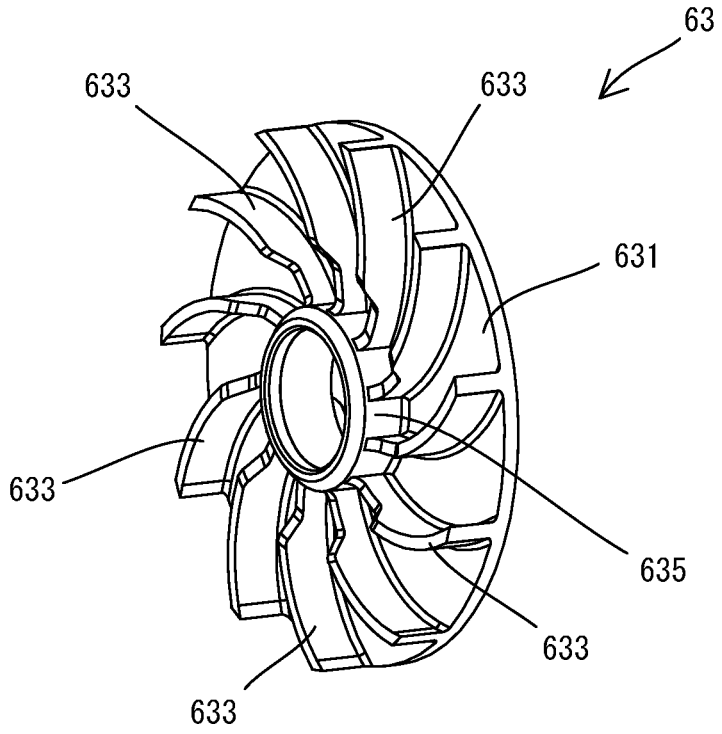
FIG. 8 is a perspective view of the body of the fan.

In this embodiment, the fan 6 is a backward curved (or inclined) fan (also called as a turbo fan) having backward curved vanes (blades). As shown in FIG. 7, a radially outer end portion of the vane 633 is inclined (curved) in a direction opposite to a rotation direction R of the fan 6. By employing such backward curved fans, compared with employing radial fans having radial vanes, a multistage centrifugal blower can deliver a relatively large volume of air with high efficiency while suppressing size increase in the radial direction.

In this embodiment, the fan 6 is formed by three members being separately formed and fixedly connected together. More specifically, as shown in FIG. 6, the fan 6 is formed by a sleeve 610, a body 63 and a locking member 65. In this embodiment, the sleeve 610 and the locking member 65 are formed of iron to ensure the strength, and the body 63 is formed of aluminum alloy to reduce the weight.

As shown in FIG. 5, the sleeve 610 is a hollow circular cylindrical member fitted around the motor shaft 45 and has an inner diameter generally equal to the diameter of the motor shaft 45. As shown in FIG. 6, about a half of the sleeve 610 is formed as a large-diameter part 612 and the remaining half is formed as a small-diameter part 614 having a smaller outer diameter. A flange 613 is formed at one end of the large-diameter part 612 on the side opposite to the small-diameter part 614. The body 63 is press-fitted onto the large-diameter part 612, as will be described in detail below. The flange 613 functions as a positioning part and a stopper for the body 63.

Figure 9:
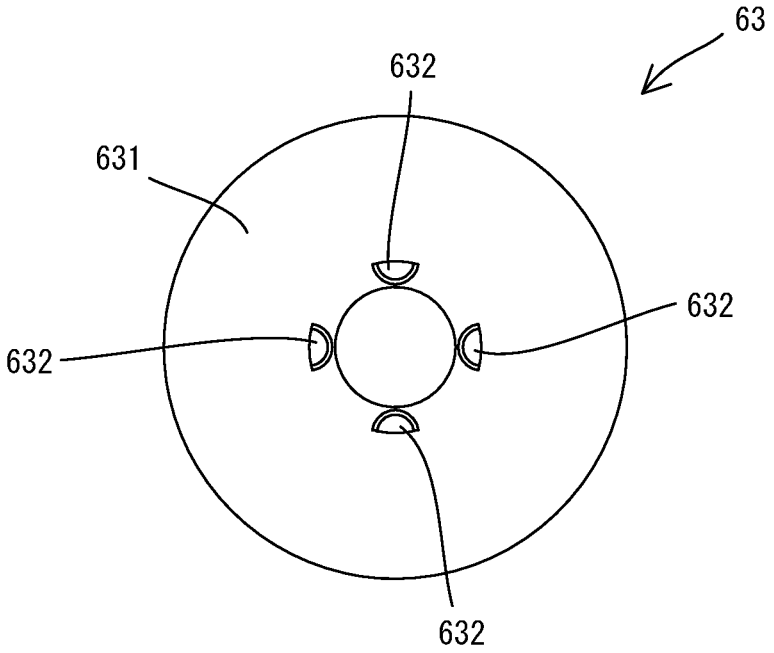
FIG. 9 is a front view of the body of the fan.

As shown in FIGS. 5 to 8, the body 63 includes the circular cylindrical boss 635, the back plate 631 and the vanes 633. The boss 635 has an inner diameter that is slightly smaller than the outer diameter of the large-diameter part 612 and is press-fitted around the large-diameter part 612 of the sleeve 610. The back plate 631 protrudes radially outward from a front end portion of the boss 635. The outer diameter of the back plate 631 is smaller than the inner diameter of the body housing 2 (the tubular part 21). In this embodiment, the outer diameter of the back plate 631 (i.e., the outer diameter of the fan (impeller) 6 (also referred to as a fan diameter)) is 50 mm. As shown in FIGS. 5 and 9, a plurality of projections 632 are formed on a front surface of the back plate 631, that is, on the surface that is opposite to the surface on which the vanes 633 are formed. In this embodiment, four projections 632 are formed at equal intervals around a through hole in the center of the body 63.

Figure 10:
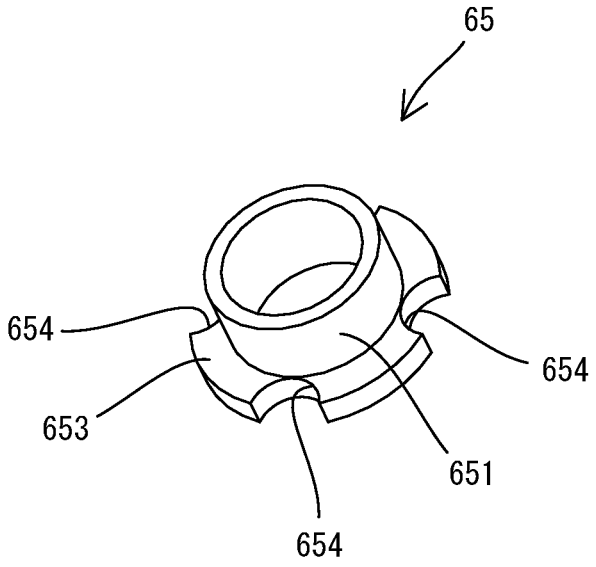
FIG. 10 is a perspective view of a locking member.

As shown in FIG. 6, the locking member 65 is press-fitted onto the small-diameter part 614 of the sleeve 610 to more firmly fix the sleeve 610 and the body 63 with each other. As shown in FIGS. 6 and 10, the locking member 65 includes a circular cylindrical boss 651 and a flange 653 protruding radially outward from one end of the boss 651 in the axial direction. The boss 651 has an inner diameter that is slightly smaller than the outer diameter of the small-diameter part 614. A plurality of recesses 654 are formed in a peripheral edge of the flange 653. In this embodiment, four recesses 654 are formed at equal intervals in the circumferential direction so as to correspond to the four projections 632 (see FIG. 9) of the body 63. Each of the recesses 654 has a shape that conforms to (matches) the projections 632.

The fan 6 is assembled in the following procedures from the sleeve 610, the body 63 and the locking member 65 which have the above-described structures. First, the body 63 is press-fitted onto the large-diameter part 612 of the sleeve 610 with the projections 632 facing away from the flange 613. The locking member 65 is then press-fitted onto the small-diameter part 614 of the sleeve 610 while being positioned relative to the body 63 in the circumferential direction such that the recesses 654 are engaged with the projections 632. In this manner, the sleeve 610, the body 63 and the locking member 65 are integrated to complete the fan 6. When the fan 6 is completed, the sleeve 610, the boss 635 of the body 63 and the boss 651 of the locking member 65 forms the hub 61. In this embodiment, the hub 61 also functions as a spacer that defines a spacing (gap) between the back plates 631 of the adjacent fans 6 when the three fans 6 are arranged in series on the motor shaft 45.

Figure 11:
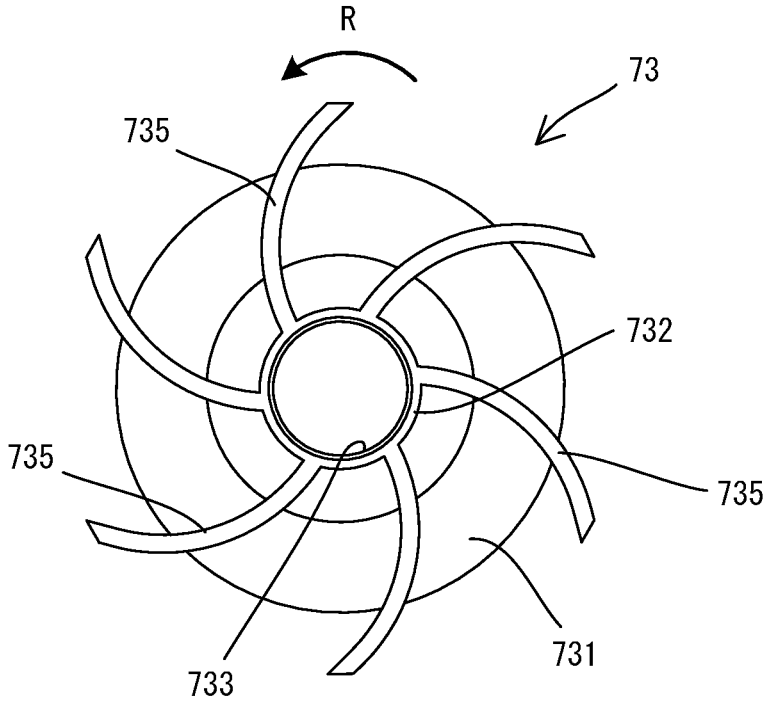
FIG. 11 is a front view of a flow-guide member for first and second stages.

The structure of the flow-guide member 73 is now described in detail. As shown in FIGS. 5 and 11, the flow-guide member 73 includes a base plate 731 and a plurality of guide vanes 735. In this embodiment, the base plate 731 and the guide vanes 735 are integrally formed of aluminum alloy.

The base plate 731 is a disc-like portion having a through hole 733 in its center. One surface of the base plate 731 is flat. The other surface has a protruding part 732 that is formed on its central portion and that protrudes while being gently curved toward the center. The base plate 731 is arranged such that the flat surface faces the front surface (the surface that is opposite to the surface on which the vanes 633 are formed) of the back plate 631 in non-contact therewith. A gap between the back plate 631 and the base plate 731 is minimized to prevent the air, which has been blown out from the outlet openings of the fan flow passages, from flowing back into the gap. The outer diameter of the base plate 731 is generally equal to the outer diameter of the back plate 631 of the fan 6. The through hole 733 is configured such that the base plate 731 does not get into contact with the fan 6 when the base plate 731 is arranged to face the back plate 631.

The guide vanes 735 are provided to direct the air radially inward. The guide vanes 735 protrude forward from a front surface of the base plate 731 on the side opposite to the other surface of the base plate 731 facing the fan 6 (the back plate 631) of the same stage. The guide vanes 735 radially extend in a curved shape from an outer periphery of the protruding part 732 of the base plate 731. The number of the guide vanes 735 is smaller than the number of the vanes 633 of the fan 6. The air, which has been pushed radially outward through the outlet openings of the fan flow passages, flows radially inward through flow passages that are each defined by the base plate 731, the adjacent guide vanes 735 and the next stage partition plate 71 (these flow passages are hereinafter referred to as return flow passages). A radially outer end portion (an end portion on the side from which the air flows in) of each of the guide vanes 735 is inclined (curved) in a direction opposite to the rotation direction R of the fan 6. Further, the radially outer end portion of the guide vane 735 protrudes radially outward of an outer edge of the base plate 731 and extends to an inner surface of the body housing 2 (the tubular part 21). Thus, the outer diameter of the flow-guide member 73 is generally equal to the inner diameter of the body housing 2 (the tubular part 21).

In this embodiment, a front end of the flow-guide member 73 (the guide vanes 735) is in abutment with the partition plate 71 of the next stage. It can therefore be said that the flow-guide member 73 and the partition plate 71 of the next stage integrally form the partitioning structure 7 that defines a boundary with the next stage. The flow-guide member 73 and the partition plate 71 can be integrally formed as a single member, but by forming them separately like in this embodiment, each of these members can have a simpler structure, so that the manufacturing costs can be reduced.

Figure 12:
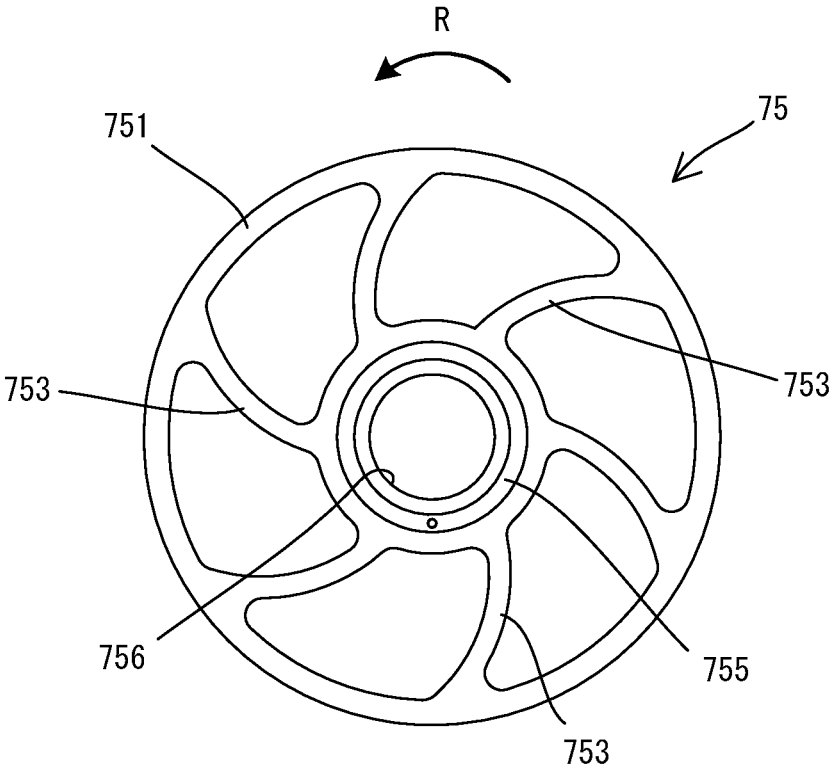
FIG. 12 is a front view of a flow-guide member for a third stage.

The structure of the flow-guide member 75 is now described in detail. As shown in FIGS. 5 and 12, the flow-guide member 75 includes a cylindrical part 751 and a plurality of guide vanes 753. In this embodiment, the flow-guide member 75 also functions as a member for holding the bearing 46. The flow-guide member 75 therefore includes a bearing-holding part 755. In this embodiment, the cylindrical part 751, the guide vanes 753 and the bearing-holding part 755 are integrally formed of aluminum alloy.

The cylindrical part 751 is fitted into the tubular part 21 of the body housing 2 and has an outer diameter that is generally equal to the inner diameter of the tubular part 21. The guide vanes 753 are provided to guide the air radially inward, and radially connect the bearing-holding part 755 and the cylindrical part 751. Like the guide vanes 735 of the flow-guide member 73, the guide vanes 753 radially extend in a curved shape, and a radially outer end portion of each of the guide vanes 753 is inclined (curved) in a direction opposite to the rotation direction R of the fan 6. The bearing-holding part 755 is formed in the center of a front end portion of the cylindrical part 751. The bearing-holding part 755 is a bottomed hollow cylindrical portion having an open front end. The bearing-holding part 755 includes a bottom wall (rear wall) having a through hole 756 and a cylindrical peripheral wall. The diameter of the through hole 756 is larger than the outer diameter of a front end portion (the locking member 65) of the hub 61 of the fan 6. The bearing 46 is fitted in the bearing-holding part 755. An outer ring 461 of the bearing 46 is in abutment with the bottom wall of the bearing-holding part 755. An inner ring 463 of the bearing 46 is press-fitted around a front end portion of the motor shaft 45 (the fan-mounting part 455) while being in abutment with a front end of the hub 61 of the third fan 603.

The male thread part 453 of the motor shaft 45 protrudes forward of the bearing 46. A nut 81 and a locking nut 83 are fastened onto the male thread part 453. A washer 89 is disposed between the bearing 46 and the nut 81. In this embodiment, the nut 81 fastens the three fans 6 to the motor shaft 45 via the inner ring 463 of the bearing 46 and also fastens the partitioning structures 7 etc. to the body housing 2 via the outer ring 461 of the bearing 46, as will be described below in detail.

The structure of the spacer 77 is now described in detail. The spacer 77 is provided in each stage (each of the first to third regions R1, R2, R3) to define a spacing (gap) between the partition plate 71 on the rear side (former stage side) and the flow-guide member 73 or 75 in abutment with the partition plate 71 and the flow-guide member 73 or 75, and thereby position the flow-guide member 73 or 75 in the front-rear direction. Specifically, three spacers 77 are respectively disposed between the first partition plate 711 and the flow-guide member 73 for the first fan 601, between the second partition plate 712 and the flow-guide member 73 for the second fan 602 and between the third partition plate 713 and the flow-guide member 75 for the third fan 603. In this embodiment, each of the spacers 77 is a hollow circular cylindrical member having an outer diameter that is generally equal to the inner diameter of the tubular part 21 and formed of a thin plate of aluminum alloy. The length of the spacer 77 in the axial direction is set such that a gap between the front surface of the back plate 631 of the fan 6 of the same stage and the rear surface of the base plate 731 of the flow-guide member 73 (a gap between the two opposed surfaces) is minimized.

Flow of the air during driving of the motor 4 is now described. When the motor 4 is driven and the three fans 6 rotate together with the motor shaft 45, the air is sucked into the body housing 2 from the inlet openings 201 (see FIG. 2). The sucked air passes through the motor region while cooling the motor body 40, and as shown by thick arrows in FIG. 5, flows into the first region R1, in which the first fan 601 is disposed, from the communication hole 710 of the first partition plate 711. The air passes through the fan flow passages of the first fan 601 and is pushed out of the first fan 601 in the radial direction from the outlet openings of the fan flow passages. In FIG. 5, for the convenience sake, only the air flow within an upper half of the body housing 2 is shown by thick arrows, but the air also flows in the same manner in other portions.

The flow direction of the air is then changed by an inner peripheral surface of the spacer 77 and the air flows into the return flow passages from between the radially outer end portions of the guide vanes 735 of the flow-guide member 73. In this embodiment, as described above, the back plate 631 of the fan 6 has generally the same outer diameter as the base plate 731 of the flow-guide member 73. Further, the guide vanes 735 of the flow-guide member 73 protrude radially outward of the base plate 731 and extend to the inner surface of the body housing 2. With such a structure, the air that has been blown out through the outlet openings of the fan flow passages can be easily led between the radially outer end portions (protruding from the base plate 731) of the guide vanes 735 from the rear (upstream), and easily led into the return flow passages formed on the front surface side of the base plate 731. Further, the guide vanes 735 are arranged such that the radially outer end portions of the guide vanes 735 are each inclined (curved) in a direction opposite to the rotation direction of the fan 6. With this structure, the air that has been blown out of the fan 6 can smoothly flow into the return flow passages along the radially outer end portions of the guide vanes 735. The air is guided radially inward through the return flow passages and flows into the second region R2 through the communication hole 710 of the second partition plate 712.

The air that has entered the second region R2 is pushed radially outward through the fan flow passages of the second fan 602 and the flow direction of the air is then changed by the inner peripheral surface of the spacer 77, so that the air easily and smoothly flows into the return flow passages of the flow-guide member 73. The air is further guided radially inward through the return flow passages and flows into the third region R3 through the communication hole 710 of the third partition plate 713. The air that has entered the third region R3 is pushed radially outward through the fan flow passages of the third fan 603 and the flow direction of the air is then changed by the inner peripheral surface of the spacer 77, and the air flows into the return flow passages formed between the guide vanes 753 of the flow-guide member 75. Like the guide vanes 735 of the flow-guide member 73, the guide vanes 753 of the flow-guide member 75 also protrude radially outward of the base plate 731 and extend to the inner surface of the cylindrical part 751. Further, the radially outer end portion of each of the guide vanes 753 is inclined in a direction opposite to the rotation direction of the fan 6. With this structure, the air that has been blown out of the third fan 603 can easily and smoothly flow into the return flow passages of the flow-guide member 75.

The air is then guided radially inward through the return flow passages, passes through the nozzle 231 of the front cover 23 and is discharged through the discharge opening 203 located on the rotational axis A1. By thus providing the flow-guide member 75 between the third fan 603 of the final stage and the discharge opening 203, the air that has been blown out of the third fan 603 can be efficiently led to the discharge opening 203 so that reduction of the blowing force is suppressed.

Assembling of the air duster 1 (particularly, assembling the fan 6 to the motor shaft 45 and assembling the partition plates 71, the spacers 77 and the flow-guide members 73, 75 to the body housing 2) is now described.

First, the motor 4 is housed within the body housing 2. Specifically, the stator 41 housed in the case 411 is disposed in the rear portion of the tubular part 21 with the front and rear covers 23, 25 removed from the tubular part 21. The rear cover 25 is then fixed to the tubular part 21 by screws 29. When the rear cover 25 is fixed to the tubular part 21, the stator 41 is supported within the body housing 2 by the ribs 211 and 251 (see FIGS. 3 and 4). The motor shaft 45 with the rotor 43 and the balance ring 431 fixed thereto is disposed within the tubular part 21, and the rear end portion of the motor shaft 45 is press-fitted into the inner ring 473 of the bearing 47.

Subsequently, the motor region and the fan region (specifically, the first region R1) are partitioned by the first partition plate 711. Specifically, the first partition plate 711 is inserted into the tubular part 21 from the front end opening of the tubular part 21, while the motor shaft 45 is inserted through the first partition plate 711. An outer peripheral portion of the first partition plate 711 abuts on the front end surface 212 of the ribs 211 of the tubular part 21, so that the first partition plate 711 is positioned relative to the tubular part 21 in the front-rear direction (see FIG. 4).

Subsequently, the elements of the first stage are arranged and the first region R1 and the second region R2 are partitioned in the following procedures.

First, the spacer 77 of the first stage is fitted into the tubular part 21 from the front end side, while the motor shaft 45 is inserted through the spacer 77. The spacer 77 abuts on the outer peripheral portion of the rear end surface of the first partition plate 711 and is thus positioned in the front-rear direction. Subsequently, the first fan 601 is fitted around the motor shaft 45 from the front end of the motor shaft 45 and inserted into the tubular part 21. A rear end of the hub 61 (specifically, the flange 613) abuts on a front end surface of the flange 451 of the motor shaft 45, so that the first fan 601 is positioned relative to the motor shaft 45 in the front-rear direction (see FIG. 5).

Further, the flow-guide member 73 is fitted into the tubular part 21 from the front end side, while the motor shaft 45 is inserted through the flow-guide member 73. Rear end surfaces of the radially outer end portions of the guide vanes 735 of the flow-guide member 73 abut on a front end surface of the spacer 77, so that the flow-guide member 73 is positioned in the front-rear direction. At this time, the flow-guide member 73 is disposed in front of (on the next stage side of) the first fan 601 with a minimum gap between the front surface of the back plate 631 of the fan 6 of the same stage and the rear surface of the base plate 731 of the flow-guide member 73. Further, the flow-guide member 73 is disposed radially outward of the hub 61 with the front portion (the locking member 65) of the hub 61 and the projections 632 of the fan 6 disposed within the through hole 733 (see FIG. 5).

Further, the second partition plate 712 is inserted into the tubular part 21. An outer peripheral portion of the second partition plate 712 abuts on the front end surface of the flow-guide member 73 of the first stage and is thus positioned in the front-rear direction. In this manner, the arrangement of the fan 6, the spacer 77 and the flow-guide member 73 in the first stage and partitioning between the first region R1 and the second region R2 are completed (see FIG. 5).

Subsequently, the elements of the second stage are arranged and the second region R2 and the third region R3 are partitioned in the following procedures.

The method of arranging the elements of the second stage is substantially the same as the above-described method in the first stage. Specifically, the spacer 77 for the second stage is fitted into the tubular part 21 and positioned in the front-rear direction. The second fan 602 is then fitted around the motor shaft 45 and positioned such that a rear end of the hub 61 abuts on a front end of the hub 61 of the first fan 601 of the first stage. A rear end of the hub 61 of the positioned second fan 602 is disposed within the communication hole 710 of the second partition plate 712. Further, the vanes 633 are spaced slightly apart forward from the second partition plate 712. The flow-guide member 73 for the second stage and the third partition plate 713 for partitioning between the second region R2 and the third region R3 are fitted into the tubular part 21 and positioned in the front-rear direction. Thus, the arrangement of the fan 6, the spacer 77 and the flow-guide member 73 in the second stage and partitioning between the second region R2 and the third region R3 are completed (see FIG. 5).

Subsequently, the elements of the third stage are arranged in the same procedures as in the second stage. Specifically, the spacer 77 for the third stage is fitted into the tubular part 21 and positioned in the front-rear direction. The third fan 603 is then fitted around the motor shaft 45 and positioned such that a rear end of the hub 61 abuts on a front end of the hub 61 of the second fan 602 of the second stage. The flow-guide member 75 for the third stage is fitted into the tubular part 21 and positioned in the front-rear direction. Thus, the arrangement of the fan 6, the spacer 77 and the flow-guide member 75 in the third stage is completed. A front end portion of the hub 61 of the fan 6 of the third stage protrudes into the bearing-holding part 755 through the through hole 756 (see FIG. 5).

When the arrangement of the elements of the third stage is completed, the three fans 6 of the first to third stages are arranged in series in the rotational-axis-A1 direction (the front-rear direction) with the adjacent hubs 61 in abutment with each other. The rear end (the flange 613) of the hub 61 of the first fan 601 abuts on the front end of the flange 451 of the motor shaft 45. The three fans 6 are, however, not yet fixed to the motor shaft 45. The first partition plate 711, the spacer 77, the flow-guide member 73, the second partition plate 712, the spacer 77, the flow-guide member 73, the third partition plate 713, the spacer 77 and the flow-guide member 75 are arranged in series in the rotational-axis-A1 direction (the front-rear direction) with outer edges of the adjacent members in abutment with each other. Further, the outer peripheral portion of the rear end surface of the first partition plate 711 abuts on the front end surface of the ribs 211 in the body housing 2 (the tubular part 21). These members are, however, not yet fixed to the body housing 2.

Subsequently, the three fans 6 are fastened (fixed) to the motor shaft 45, and also the partition plates 71, the spacers 77 and the flow-guide members 73, 75 are fastened (fixed) to the body housing 2, by means of the nut 81, in the following procedures.

First, the bearing 46 is loosely fitted around the male thread part 453 (front end portion) of the motor shaft 45 and partly disposed within a front end portion of the bearing-holding part 755. Further, the annular washer 89 is fitted around the male thread part 453 in front of the bearing 46. The inner diameter of the washer 89 is generally equal to the outer diameter of the male thread part 453, and the outer diameter of the washer 89 is smaller than the inner diameter of the outer ring 461 of the bearing 46. The washer 89 therefore abuts on the inner ring 463 of the bearing 46, but not on the outer ring 461. Subsequently, the nut 81 is fastened (tightened) onto the male thread part 453 from the front side of the washer 89. As the nut 81 is moved rearward along the motor shaft 45 while being fastened, the bearing 46 is pressed via the washer 89 and moved rearward within the bearing-holding part 753, and the inner ring 463 is press-fitted around the front end portion of the fan-mounting part 455.

The nut 81 is further fastened while the inner ring 463 of the bearing 46 abuts on the front end of the hub 61 of the third fan 603 and also the outer ring 461 abuts on the bottom wall of the bearing-holding part 755. Thus, the washer 89, the inner ring 463 of the bearing 46, the hub 61 of the third fan 603, the hub 61 of the second fan 602 and the hub 61 of the first fan 601 are held between the nut 81 and the flange 451 and fastened (fixed) to the motor shaft 45 by an axial force acting on the motor shaft 45. Further, the outer ring 461 of the bearing 46, the flow-guide member 75, the spacer 77, the third partition plate 713, the flow-guide member 73, the spacer 77, the second partition plate 712, the flow-guide member 73, the spacer 77 and the first partition plate 711 are held between the nut 81 and the ribs 211 and fastened (fixed) to the body housing 2 by the axial force.

Thereafter, the locking nut 83 is fastened (tightened) onto the male thread part 453 to prevent the nut 81 from loosening. Further, the front cover 23 is threadedly engaged with the front end portion of the tubular part 21. Thus, assembling of the body housing 2 is completed. Thereafter, the handle 3 is fixed to the body housing 2 to complete assembling of the air duster 1.

As described above, the air duster 1 of this embodiment is a three-stage centrifugal blower, in which the partition plates 71 (the first to third partition plates 711, 712, 713) are respectively disposed on the suction sides of the three fans (centrifugal fans) 6 and define boundaries of the regions of the three stages. Further, in each of the stages other than the final stage (i.e. the first and second stages), the flow-guide member 73 is provided, corresponding to each of the fans 6 (the first and second fans 601, 602). The vanes 633 of the fan 6 protrude from the rear surface of the back plate 631 on the suction side, and the guide vanes 635 of the flow-guide member 73 protrude from the front surface of the base plate 731 on the side opposite to the fan 6. The rear surface of the base plate 731 on the fan 6 side does not have any protrusions such as vanes for guiding the air flow in some direction, so that the base plate 731 and the back plate 631 can be arranged as close as possible to each other. This arrangement can reduce the possibility that the air, which has been blown radially outward of the fan 6, flows radially inward between the base plate 731 and the back plate 631 due to a pressure difference. Further, the absence of protrusions on the rear surface of the base plate 731 can reduce the possibility of interference between the fan 6 and the flow-guide member 73 during assembling, which can make the assembling easier. Thus, the air duster 1 with a rational structure is provided.

In the air duster 1 of this embodiment, the two partitioning structures 7 (the flow-guide member 73 and the second partition plate 712; and the flow-guide member 73 and the third partition plate 713) are respectively disposed between the three fans 6 (the first to third fans 601, 602, 603) and partition the internal space of the body housing 2 into the first to third regions R1, R2, R3. Further, the three fans 6 are fastened to the motor shaft 45 and also the two partitioning structures 7 (specifically, the above-described two partitioning structures 7, the first partition plate 711, the flow-guide member 75 and the three spacers 77) are fastened to the body housing 2, by means of the single common nut 81.

With such structure, as described above, in assembling the air duster 1, mounting the fans 6 to the motor shaft 45 and mounting the partitioning structures 7 to the body housing 2 can be performed in one operation using the single nut 81. Thus, the air duster 1 realizes a multistage blower that is superior in ease of assembling. Particularly, in this embodiment, the fans 6 and the partitioning structures 7 are fastened by screwing the threaded nut 81 onto the male thread part 453 of the motor shaft 45, so that the assembling is very easy. Further, by screwing the locking nut 83, in addition to the nut 81, onto the motor shaft 45, the fans 6 and the partitioning structures 7 can be more reliably fastened.

Further, in this embodiment, the nut 81 fastens the fans 6 to the motor shaft 45 via the inner ring 463 of the bearing 46 and also fastens the partitioning structures 7 to the body housing 2 via the outer ring 461. Thus, by utilizing the bearing 46, which has the outer ring 461 and the inner ring 463 that are movable relative to each other and that rotatably support the motor shaft 45, the fans 6 and the partitioning structures 7 can be easily fastened via different routes (elements) with the single nut 81. Further, looseness of the motor shaft 45 can be suppressed, so that the rotor 43 can be properly positioned relative to the stator 41. The fan-mounting part 455 of the motor shaft 45 has a uniform diameter, so that the motor shaft 45 can be easily manufactured and the three fans 6 to be fastened to the motor shaft 45 can have the same structure.

Further, in this embodiment, each of the partitioning structures 7 includes the partition plate 71, which defines a boundary with the next stage and which has the communication hole 710 which leads the air into the next stage, and the flow-guide member 73, which is disposed in abutment with the partition plate 71 and which directs the air that has been pushed out by the fan 6 radially inward toward the communication hole 710. Therefore, in each of the first and second stages, the structure for efficiently guiding the air from the fan 6 into a suction region of the next-stage fan 6 can be easily fixed to the body housing 2 with the nut 81. Further, in this embodiment, the flow-guide member 75 is also provided in the final third stage to guide the air from the third fan 603 toward the discharge opening 203. The flow-guide member 75 is also fastened to the body housing 2 with the nut 81. Thus, the structure for efficiently guiding the air from the third fan 603 to the discharge opening 203 and thereby suppressing reduction of the blowing force can be also easily fixed to the body housing 2.

Details relating to numerical value settings of the specifications of the air duster 1 are now described.

In this embodiment, the air duster 1 is configured as an electric multistage blower that is small but capable of exhibiting a sufficient blowing force (discharge performance) for blowing off grits, dust and the like when the motor 4 is driven at the maximum rotational speed. Generally, the blowing force of 1 to 3 newtons (N) is considered to be sufficient for blowing off the grits, dust, etc. This force is measured in accordance with the "ANSI B175.2 standard" specified by American National Standards Institute (ANSI).

In this embodiment, the diameter of the discharge opening 203 of the air duster 1 (nozzle diameter), the outer diameter of the fan 6 (fan diameter) and the maximum rotational speed of the motor 4 are selected according to the required blowing force in the following procedures.

First, the required blowing force F (N) is selected within a range of 1 to 3 N. The blowing force F can be expressed by Equation 1 below, wherein p (kilogram per cubic meter: $kg/m^3$) is the air density, Q (cubic meter per second: $m^3/s$) is the volume of air passing through the discharge opening 203, V (meter per second: m/s) is the air velocity, A (square meter: $m^2$) is the area of the discharge opening 203 and d (meter: m) is the nozzle diameter.

$$F = \rho QV = \frac{\rho Q^2}{A} = \frac{4\rho Q^2}{\pi d^2} \quad \text{(Equation 1)}$$

The air density p in Equation 1 is a known value. Therefore, if the nozzle diameter d is selected, the air volume Q required for obtaining the desired blowing force F can be calculated based on Equation 1. In this embodiment, considering the size reduction of the body housing 2, the nozzle diameter d is selected within a range of 2.5 mm to 10 mm. It may be more preferable that the nozzle diameter d is selected within a range of 5 mm to 10 mm, in order to efficiently blow off the grits and dust by blowing air to a wide range as much as possible. The required air volume Q is calculated with the nozzle diameter d selected within such a range. Further, the air velocity V is calculated based on the relation between the area A of the discharge opening 203 and the air volume Q (Q=AV).

Further, the air velocity V can be expressed by Equation 2 below, wherein P (pascal: Pa) is the pressure of the air discharged through the discharge opening 203, $P_b$ (Pa) is the back pressure and $\gamma$ is the specific heat ratio of air.

$$V = \sqrt{\frac{2\gamma}{\gamma - 1}\frac{P}{\rho}\left(1 - \frac{P_b}{P}\right)^{\frac{\gamma-1}{\gamma}}} \quad \text{(Equation 2)}$$

In Equation 2, the back pressure $P_b$ is an atmospheric pressure, which is a known value, and the air density $\rho$ and the specific heat ratio $\gamma$ are also known values. Therefore, the pressure P (also referred to as a required pressure P) required to obtain the air velocity V can be calculated based on Equation 2.

The theoretical shutoff pressure $P_{th}$ can be expressed by Equation 3 below, wherein $P_{th}$ (Pa) is the theoretical shutoff pressure (the pressure that is theoretically obtained when the discharge opening 203 is completely shut off), k is a slip factor, $u_2$ (m/s) is the peripheral speed of the fan 6, n (rotation per minute: rpm) is the maximum rotational speed of the motor 4, and $D_2$ (m) is the fan diameter.

$$P_{th} = (1 - \kappa)\rho u_2^2 = (1 - \kappa)\rho\left(\frac{\pi n D_2}{60}\right)^2 \quad \text{(Equation 3)}$$

In Equation 3, the slip factor k and the air density $\rho$ are known values. Therefore, assuming that the required pressure P is the theoretical shutoff pressure $P_{th}$, a combination of the fan diameter $D_2$ and the maximum rotational speed n that is required to obtain the required pressure P can be selected based on Equation 3. In this embodiment, considering the size reduction of the body housing 2, the fan diameter $D_2$ is selected within a range of 30 mm to 70 mm, more preferably, within a range of 30 mm to 50 mm. Further, while the nozzle diameter d and the fan diameter $D_2$ are thus set relatively small, the maximum rotational speed n of the motor 4 is selected within a range of 50,000 rpm to 120,000 rpm, which indicates a relatively high speed. Considering the cost reduction, it may be preferable that the maximum rotational speed n of the motor 4 is selected within a range of 50,000 rpm to 70,000 rpm.

The theoretical shutoff pressure $P_{th}$ here is the highest pressure that is theoretically obtained when the discharge opening 203 is completely shut off, and thus the actual pressure of the air to be discharged is assumed to be about 20 percent (%) of the theoretical shutoff pressure $P_{th}$. Therefore, if only one fan 6 is provided, the required pressure P cannot be actually obtained with the fan diameter $D_2$ and the maximum rotational speed n respectively selected within the above-described ranges. Accordingly, a combination of the fan diameter $D_2$ and the maximum rotational speed n is selected that can realize the required pressure P when the fans 6 are arranged in multiple stages.

In this embodiment, the required blowing force F is set to 1.5 N, and the nozzle diameter, the fan diameter, the maximum rotational speed of the motor 4 and the number of the stages of the fans 6 are determined by the above-described procedures. Specifically, the nozzle diameter is 6 mm, the fan diameter is 50 mm, the maximum rotational speed of the motor 4 is 63,000 rpm, and the number of stages of the fans 6 is 3. The air volume of the air duster 1 is about 0.36 $m^3$/s, the air velocity is about 212 m/s, and the pressure is about 26.6 kPa, which are measured in accordance with Japanese Industrial Standard (JIS) "JIS B8330". It can be said that the air duster 1 is a multistage centrifugal blower of a type that is capable of blowing air of a relatively small volume and high pressure.

As described above, in the air duster 1 of this embodiment, the nozzle diameter and the fan diameter are respectively selected within the above-described ranges and thus the diameters of the nozzle 231 and the fans 6 are reduced, so that the body housing 2 can be relatively reduced in size. Possible reduction of the blowing force resulting from the reduction of the diameters of the nozzle 231 and the fans 6 can be suppressed (offset) by the maximum rotational speed of the motor 4 being selected within the above-described range and thus set relatively high. In this manner, with the specifications set within the above-described ranges, the electric multistage blower can be obtained that is relatively small in size and that is capable of exhibiting a sufficient force for blowing off the grits, dust, etc.

Further, in this embodiment, the motor 4 is a brushless motor, and the controller 331 is configured to control the rotational speed of the motor 4 according to the manipulation amount of the trigger 311. Therefore, the user can adjust the rotational speed and thus the blowing force, by way of manipulating the trigger 311. Further, the air duster 1 is a hand-held blower that the user can use while holding the handle 3 (the grip part 31) and depressing the trigger 311, and thus has high convenience.

Correspondences between the features of the above-described embodiment and the features of the present disclosure are as follows. The features of the above-described embodiment are, however, merely exemplary and thus do not limit the features of the invention. The air duster 1 is an example of the "blower". The motor 4 is an example of the "motor". The fan 6 is an example of the "fan". The rotational axis A1 is an example of the "rotational axis". The body housing 2, the inlet opening 201 and the discharge opening 203 are examples of the "housing", the "inlet opening" and the "discharge opening", respectively. The battery mounting part 34 is an example of the "battery mounting part". The battery 340 is an example of the "battery". The trigger 311 is an example of the "manipulation member". The controller 331 is an example of the "control device". The handle 3 (the grip part 31) is an example of the "grip part".

The partition plate 71 (each of the first partition plate 711, the second partition plate 712 and the third partition plate 713) is an example of the "partition plate". The communication hole 710 is an example of the "communication hole". Each of the first region R1, the second region R2 and the third region R3 is an example of the "region corresponding to the fan". The flow-guide member 73 is an example of the "flow-guide member". The back plate 631 is an example of the "back plate". The rear surface and the front surface of the back plate 631 are examples of the "first surface" and the "second surface", respectively. The vane 633 is an example of the "vane". The base plate 731 is an example of the "base plate". The rear surface and the front surface of the base plate 731 are examples of the "third surface" and the "fourth surface", respectively. The guide vane 735 is an example of the "protrusion" and the "guide vane".

The above-described embodiment is merely exemplary and a blower according to the present disclosure is not limited to the air duster 1 of the above-described embodiment. For example, the following modifications may be made. One or more of these modifications may be employed in combination with the air duster 1 of the above-described embodiment or with the features described in each claim.

For example, the power source of the air duster 1 is not limited to the rechargeable battery 340, but may be a disposable battery. The motor 4 may be a brushed motor.

The number of the fans 6 (i.e., the number of the stages) is not limited to three, but may be one, two, four or more. The number of the fans 6 can be appropriately selected, for example, depending on the above-described specifications of the air duster 1.

The structure of the fan 6 can also be appropriately changed. For example, the type of the fan 6 is not limited to the above-described open-type backward curved fan, but may be a centrifugal fan of another type (such as a closed-type backward curved fan, a radial fan and a sirocco fan), a mixed flow fan or an axial fan. The size and shape of the back plate 631 and the number, size, shape and arrangement of the vanes (blades) 633 can be appropriately changed. The fans 6 may be entirely or partially integrated, instead of being formed by a plurality of members fixedly connected together. All of the fans 6 need not necessarily have the same structure.

The fans 6 need not necessarily be fastened to the motor shaft 45 with the nut 81, but, for example, each of the fans 6 may be press-fitted and fixed onto the motor shaft 45. The fans 6 may be fastened or press-fitted onto a rotary shaft that is different from the motor shaft 45 and that is rotationally driven by driving of the motor 4.

As long as the partitioning structures 7 are disposed between the fans 6 in the rotational-axis-A1 direction and partition the internal space of the body housing 2 into multiple regions that respectively correspond the fans 6, the number of the partitioning structures 7 is not limited to that of the above-described embodiment. Specifically, the number of the partitioning structures 7 depends on the number of the fans 6. In a case where two fans 6 are provided, the number is one, and in a case where three or more fans 6 are provided, the number of the partitioning structures 7 is two or more (one less than the number of the fans 6).

The structure of the partitioning structure 7 can also be appropriately changed. In the above-described embodiment, the partitioning structure 7 includes the flow-guide member 73 and the partition plate 71 that are separately formed from each other, but the flow-guide member 73 and the partition plate 71 may be integrally formed with each other as a single member. Alternatively, for example, the partition plate 71 may be omitted, and the flow-guide member 73 may also serve as a partition plate. In other words, the partitioning structure 7 may be formed only by the flow-guide member 73. For example, in a case where the flow-guide member 73 is arranged such that the guide vanes 735 protrude rearward (toward the fan 6 of the same stage) from the base plate 731, the base plate 731 can also serve as a partition plate for defining the boundary with the next stage. In a case where a plurality of the partition plates 71 are provided, all of the partition plates 71 need not necessarily have the same structure.

In the above-described embodiment, the spacer 77, which is separately formed from the partitioning structure 7 and provided to position the partitioning structure 7 in the rotational-axis-A1 direction (front-rear direction), is fastened to the body housing 2 together with the partitioning structure 7. For example, however, each of the spacers 77 of the first and second stages may be integrally formed with the flow-guide member 73 of the same stage. Alternatively, each of the spacers 77 of the first and second stages may be integrally formed with both the flow-guide member 73 of the same stage and the partition plate 71 (the second partition plate 712 or the third partition plate 713) provided on the next stage side of (in front of) this flow-guide member 73. Alternatively, each of the spacers 77 may be integrally formed with the partition plate 71 (the first partition plate 711 or the second partition plate 712) provided on the former stage side of (behind) the spacer 77. Similarly, the spacer 77 of the third stage may be integrally formed with the flow-guide member 75, or with the partition plate 71 (the third partition plate 713) provided on the former stage side of (behind) the spacer 77. The flow-guide member 75 disposed between the fan 6 of the final stage and the discharge opening 203 may be omitted.

The structures of the partition plate 71, the flow-guide members 73, 75 and the spacer 77 are not limited to those of the above-described embodiment. For example, the size and shape of the base plate 731 of the flow-guide member 73 can be appropriately changed. For example, the base plate 731 may have an outer diameter that is larger or smaller than the outer diameter of the back plate 631 of the fan 6. The number, size, shape, arrangement and orientation of the guide vanes 735, 753 of the flow-guide members 73, 75 can be appropriately changed. For example, the radially outer end of each of the guide vanes 735 may be arranged in the same position as the outer edge of the base plate 731. Further, for example, the flow-guide members 73, 75 may have other protrusions for guiding the air flow in a specific direction, in addition to the guide vanes 735, 753 formed on the front surface (on the side opposite to the fan 6). For example, the flow-guide members 73, 75 may have diffusers protruding from the rear surface (facing the back plate 631 of the fan 6). Further, in the above-described embodiment, the ribs 211 of the body housing 2 support the first partition plate 711, but a portion(s) other than the ribs 211 of the body housing 2 may support the partitioning structure 7 or an intervening member.

In the above-described embodiment, the fans 6 are fastened to the motor shaft 45, and also the partition plates 71, the flow-guide members 73, 75 and the spacers 77 are fastened to the body housing 2, by the single nut 81 being threadedly engaged with and fixed to the motor shaft 45. The partition plates 71 and the flow-guide members 73, 75 may, however, be fixed to the body housing 2, independently of the fans 6. In this case, the spacers 77 may be omitted. The method of fixing the partition plates 71 and the flow-guide members 73, 75 is not limited to fastening such as in the above-described embodiment. For example, in a case where the body housing 2 is formed by two halves that are divided along a plane that is parallel to the rotational axis A1, the partition plates 71 may be integrally formed with the body housing 2, and the flow-guide members 73, 75 may be held by ribs formed in the body housing 2.

The structure of the body housing 2 and the arrangement of the elements within the body housing 2 can be appropriately changed. For example, the shape of the body housing 2 (the tubular part 21) is not limited to the circular cylinder shape, but may be changed to another shape such as a rectangular cylinder shape. The size, shape and arrangement of the inlet openings 201 and the discharge opening 203 may be appropriately changed from those of the above-described embodiment. The motor 4 may be disposed not between the inlet openings 201 and the fan 6 of the first stage, but between the fan 6 of the final stage and the discharge opening 203. The structure of the handle 3 can also be appropriately changed. In place of the handle 3, a portion of the body housing 2 may form a grip part to be held by the user.

In the above-described embodiment, the rotational speed of the motor 4 can be steplessly changed according to the manipulation amount of the trigger 311, but may be unchangeable from a predetermined speed or may be changeable in multiple steps. For example, the air duster 1 may be configured such that the rotational speed of the motor 4 can be set in multiple steps by manipulating the manipulation part 333 (the push buttons). In this case, the controller 331 may control the rotational speed of the motor 4 in response to a signal outputted from the manipulation part 333. The manipulation member via which a setting of the rotational speed of the motor 4 can be inputted may be a dial or a touch panel, besides the trigger 311 or a push button. The controller 331 may be formed not by a microcomputer but by a control circuit of another kind.

Further, in view of the nature of the present disclosure, the above-described embodiment and the modifications thereto, the following Aspects 1 to 4 are provided. Any one or more of the following Aspects 1 to 4 can be employed in combination with any one of the air duster 1 of the above-described embodiment and modifications, and the features described in each claim.

(Aspect 1)

The vanes are each arranged such that a radially outer end portion of each of the vanes is inclined in a direction opposite to a rotation direction of the centrifugal fan.

(Aspect 2)

The guide vanes protrude radially outward of the base plate and extend to an inner surface of the housing.

(Aspect 3)

The back plate and the base plate have the same outer diameter.

(Aspect 4)

The blower further comprises a final flow-guide member that is disposed between the fan of a final stage and the discharge opening and configured to direct the air from the fan of the final stage toward the discharge opening.

The flow-guide member 75 of the above-described embodiment is an example of the "final flow-guide member" in this Aspect.

Further, the following Aspects 5 to 16 are provided with the aim to provide a multistage centrifugal blower having a rational structure. Each of the following Aspects 5 to 16 may be employed individually or in combination with any one or more of the other Aspects. Alternatively, at least one of the following Aspects 5 to 16 may be employed in combination with any one of the air duster 1 of the above-described embodiment, the above-described modifications and Aspects 1 to 4, and the features described in each claim.

(Aspect 5)

A blower, comprising:

a motor;

a plurality of centrifugal fans that are coaxially arranged in multiple stages and configured to suck air in a direction of a specified rotational axis and blow the air radially outward by rotating around the rotational axis when the motor is driven;

a housing that houses the motor and the centrifugal fans, the housing having an inlet opening through which the air is sucked into the housing and an discharge opening through which the air compressed and blown by the centrifugal fans is discharged;

a plurality of partition plates that are respectively arranged on suction sides of the centrifugal fans in the axial direction and define boundaries of regions corresponding to the centrifugal fans, the partition plates each having a communication hole on the rotational axis, and at least one flow-guide member that is arranged between the centrifugal fans in the axial direction, wherein:

each of the centrifugal fans includes:

a disc-like back plate having a first surface on a suction side and a second surface on a side opposite to the first surface; and a plurality of vanes protruding from the first surface, the at least one flow-guide member each includes:

a disc-like base plate that is arranged to face the second surface of the back plate, the base plate having a third surface facing the second surface, and a fourth surface on a side opposite to the third surface, and a plurality of protrusions protruding from the base plate and configured to guide air flow in a specific direction, and all of the protrusions are formed on the fourth surface of the base plate and configured as a plurality of guide vanes configured to guide the air flow toward the communication hole of the partition plate corresponding to the centrifugal fan of a next stage.

In the multistage centrifugal blower according to this Aspect, the partition plates are respectively arranged on the suction sides of the centrifugal fans and define boundaries of the regions of the stages, and the flow-guide member is provided for the centrifugal fan in each stage other than the final stage. The vanes of the centrifugal fan protrude from the first surface of the back plate on the suction side, and the guide vanes of the flow-guide member protrude from the fourth surface of the base plate on the side opposite to the centrifugal fan. The third surface of the base plate on the centrifugal fan side does not have any protrusions, so that the base plate and the back plate can be disposed as close as possible to each other. With this structure, the possibility can be reduced that the air blown radially outward from the centrifugal fan flows radially inward between the base plate and the back plate by a pressure difference. Further, the absence of a protrusion on the third surface can reduce the possibility of interference between the centrifugal fan and the flow-guide member during assembling, which can facilitate the assembling. Thus, this Aspect provides the multistage centrifugal blower with a rational structure.

In this aspect, the motor may be driven with power supplied from a battery or from an external AC power source. The motor may be a brushed motor or may be a brushless motor. It may be preferable that a brushless motor is employed since it is compact and provides high output and its speed is variable.

The number of the centrifugal fans (the number of the stages) is not particularly limited, and can be appropriately selected, for example, depending on the blowing force required of the blower. The centrifugal fans may be a backward curved fan (also called as a turbo fan) having backward curved vanes, a radial fan having radial vanes, or a multivane fan having forward curved vanes (also called as a sirocco fan). All of the centrifugal fans need not necessarily have the same structure, but preferably have the same structure from the viewpoints of the manufacturing costs and ease of assembling.

The number of the flow-guide members depends on the number of the centrifugal fans. In a case where two centrifugal fans are provided, the number of the flow-guide member is one, and in a case where three or more centrifugal fans are provided, the number of the flow-guide members is two or more (one less than the number of the centrifugal fans). In a case where a plurality of the flow-guide members are provided, all of the flow-guide members need not necessarily have the same structure, but preferably have the same structure from the viewpoints of the manufacturing costs and ease of assembling.

(Aspect 6)

The blower as defined in Aspect 5, wherein the guide vanes are arranged such that a radially outer end portion of each of the guide vanes is inclined in a direction opposite to a rotation direction of the centrifugal fan.

According to this aspect, the air blown by the centrifugal fans can smoothly flow into return flow passages that are defined between the adjacent guide vanes, along the radially outer end portions of the guide vanes.

(Aspect 7)

The blower as defined in Aspect 5 or 6, wherein:

the vanes are arranged such that a radially outer end portion of each of the vanes is inclined in a direction opposite to a rotation direction of the centrifugal fan.

In other words, the centrifugal fan may be a backward curved fan having backward curved vanes. This Aspect can provide the multistage centrifugal blower that is capable of blowing out a relatively large volume of air with high efficiency while suppressing size increase in the radial direction.

(Aspect 8)

The blower as defined in any one of Aspects 5 to 7, wherein:

the guide vanes protrude radially outward of the base plate and extend to an inner surface of the housing.

According to this Aspect, the air blown radially outward by the centrifugal fans can be easily led into passages to the communication hole leading to the next stage from between the radially outer end portions of the guide vanes. The inner surface of the housing here is not required to be an inner surface of the housing itself, but may be an inner surface of a wall portion that is disposed within the housing and defines an outer periphery of a region for each fan.

(Aspect 9)

The blower as defined in any one of Aspects 5 to 8, wherein the back plate and the base plate have the same outer diameter.

The term "same" used in this Aspect is not required to mean being exactly the same, but it is sufficient that the diameters are about the same in consideration of possible errors. According to this Aspect, the air blown out from between the radially outer end portions of the vanes formed on the first surface can be easily led toward the fourth surface of the base plate on which the guide vanes are formed.

(Aspect 10)

The blower as defined in any one of Aspects 5 to 9, further comprising:

a final flow-guide member that is disposed between a centrifugal fan of a final stage and the discharge opening and configured to direct the air from the centrifugal fan of the final stage toward the discharge opening.

According to this Aspect, the air blown from the centrifugal fan of the final stage can be efficiently guided to the discharge opening so that reduction of the blowing force can be suppressed.

(Aspect 11)

The blower as defined in any one of Aspects 5 to 10, wherein the partition plates and the at least one flow-guide member are separately formed from each other.

According to this Aspect, compared with a structure in which the partition plate and the flow-guide member are integrally formed as a single member, each of these members can be provided with a simpler structure, so that the manufacturing costs can be reduced.

(Aspect 12)

The blower as defined in any one of Aspects 5 to 11, wherein a stator and a rotor of the motor are located between the inlet opening and a centrifugal fan of a first stage.

According to this Aspect, the air sucked through the inlet opening by the centrifugal fans can be utilized to cool the stator and the rotor that form the body of the motor.

(Aspect 13)

The blower as defined in any one of Aspects 5 to 12, wherein the second surface of the back plate and the third surface of the base plate are flat and are arranged parallel to each other.

(Aspect 14)

The blower as defined in any one of Aspects 5 to 13, further comprising:

a rotary shaft that is configured to rotate around the rotational axis by driving of the motor, and a single fastening member that is configured to fasten the centrifugal fans to the rotary shaft and also to fasten the partition plates and the at least one flow-guide member to the housing.

According to this Aspect, in assembling the blower, mounting the centrifugal fans to the rotary shaft and mounting the partition plates and the flow-guide member to the housing can be performed in one operation using the single fastening member. Thus, this Aspect can provide the multistage centrifugal blower that is superior in ease of assembling.

(Aspect 15)

The blower as defined in Aspect 14, further comprising:

a bearing that includes a first part and a second part and supporting the rotary shaft to be rotatable around the rotational axis relative to the housing, the first part and the second part being rotatable relative to each other, wherein:

the fastening member is configured to fasten the centrifugal fans to the rotary shaft via the first part and also to fasten the partition plates and the at least one flow-guide member to the housing via the second part.

(Aspect 16)

The blower as defined in Aspect 14 or 15, wherein:

the motor includes a stator held by the housing, a rotor disposed inside the stator, and an output shaft to which the rotor is fixed, and the rotary shaft is the output shaft.

Correspondences between the features of the above-described embodiment and the features of the Aspects 5 to 16 are as follows. The air duster 1 is an example of the "blower". The motor 4 is an example of the "motor". The fan 6 is an example of the "centrifugal fan". The rotational axis A1 is an example of the "rotational axis". The body housing 2, the inlet opening 201 and the discharge opening 203 are examples of the "housing", the "inlet opening" and the "discharge opening", respectively. The partition plate 71 (each of the first partition plate 711, the second partition plate 712 and the third partition plate 713) is an example of the "partition plate". The communication hole 710 is an example of the "communication hole". Each of the first region R1, the second region R2 and the third region R3 is an example of the "region corresponding to the fan". The flow-guide member 73 is an example of the "flow-guide member". The back plate 631 is an example of the "back plate". The rear surface and the front surface of the back plate 631 are examples of the "first surface" and the "second surface", respectively. The vane 633 is an example of the "vane". The base plate 731 is an example of the "base plate". The rear surface and the front surface of the base plate 731 are examples of the "third surface" and the "fourth surface", respectively. The guide vane 735 is an example of the "protrusion" and the "guide vane". The flow-guide member 75 is an example of the "final flow-guide member". The stator 41 and the rotor 43 are examples of the "stator" and the "rotor", respectively. The motor shaft 45 and the nut 81 are examples of the "rotary shaft" and the "fastening member", respectively. The bearing 46, the inner ring 463 and the outer ring 461 are examples of the "bearing", the "first part" and the "second part", respectively.

The blower as defined in Aspects 5 to 16 is not limited to the air duster 1 of the above-described embodiment. For example, the following modifications may be made. Any one or more of these modifications may be employed in combination with the air duster 1 of the above-described embodiment or with the features defined in each Aspect.

For example, the power source of the air duster 1 is not limited to the rechargeable battery 340, but may be a disposable battery or an external AC power source. A rechargeable battery may be incorporated in the air duster 1. The motor 4 may be a brushed motor.

The number of the fans 6 (the number of the stages) is not limited to three, but may be two or four or more. The number of the fans 6 can be appropriately selected, for example, depending on the blowing force required of the air duster 1.

The structure of the fan 6 can also be appropriately changed. For example, the type of the fan 6 is not limited to the open-type backward curved fan, but may be a centrifugal fan of another type (such as a closed-type backward curved fan, a radial fan and a scirocco fan). The size and shape of the back plate 631 and the number, size, shape and arrangement of the vanes 633 can be appropriately changed. The fans 6 may be entirely or partially integrated, instead of being formed by a plurality of members fixedly connected together. All of the fans 6 need not necessarily have the same structure.

The fans 6 need not necessarily be fastened to the motor shaft 45 with the nut 81, but, for example, each of the fans 6 may be press-fitted and fixed onto the motor shaft 45. The fans 6 may be fastened or press-fitted to a rotary shaft that is different from the motor shaft 45 and that is rotationally driven by driving of the motor 4.

As long as the partitioning structures 7 are arranged between the fans 6 in the rotational-axis-A1 direction and partition the internal space of the body housing 2 into plural regions corresponding to the fans 6, the number of the partitioning structures 7 is not limited to that of the above-described embodiment. Specifically, the number of the partitioning structures 7 depends on the number of the fans 6. In a case where the number of the fans 6 is two, the number of the partitioning structure 7 is one, and in a case where the number of the fans 6 is three or more, the number of the partitioning structures 7 is two or more (one less than that of the fans 6).

The structure of the partitioning structure 7 can also be appropriately changed. In the above-described embodiment, the partitioning structure 7 includes the flow-guide member 73 and the partition plate 71 that are separately formed from each other, but the flow-guide member 73 and the partition plate 71 may be integrally formed with each other as a single member. In a case where multiple partitioning structures 7 are provided, all of the partitioning structures 7 (the partition plates 71 and the flow-guide members 73) need not necessarily have the same structure.

In the above-described embodiment, the spacer 77, which is separately formed from the partitioning structure 7 and provided to position the partitioning structure 7 in the rotational-axis-A1 direction (front-rear direction), is fastened to the body housing 2 together with the partitioning structure 7. For example, however, each of the spacers 77 of the first and second stages may be integrally formed with the flow-guide member 73 of the same stage, or may be integrally formed with the flow-guide member 73 of the same stage and the partition plate 71 (the second partition plate 712 or the third partition plate 713) provided on the next stage side of (in front of) this flow-guide member 73. Alternatively, each of the spacers 77 may be integrally formed with the partition plate 71 (the first partition plate 711 or the second partition plate 712) provided on the former stage side of (behind) the spacer 77. Similarly, the spacer 77 of the third stage may be integrally formed with the flow-guide member 75, or the partition plate 71 (the third partition plate 713) provided on the former stage side of (behind) the spacer 77. The flow-guide member 75 arranged between the fan 6 of the final stage and the discharge opening 203 may be omitted.

The structures of the partition plate 71, the flow-guide members 73, 75 and the spacer 77 are not limited to those of the above-described embodiment. For example, the size and shape of the base plate 731 of the flow-guide member 73 can be appropriately changed. For example, the base plate 731 may have an outer diameter that is larger or smaller than the outer diameter of the back plate 631 of the fan 6. The number, size, shape, arrangement and orientation of the guide vanes 735, 753 of the flow-guide members 73, 75 can be appropriately changed. For example, the radially outer end of each of the guide vanes 735 may be arranged in the same position as the outer edge of the base plate 731. Further, in the above-described embodiment, the ribs 211 of the body housing 2 support the first partition plate 711, but a portion(s) other than the ribs 211 of the body housing 2 may support the partitioning structure 7 or an intervening member.

In the above-described embodiment, the fans 6 are fastened to the motor shaft 45, and also the partition plates 71, the flow-guide members 73, 75 and the spacers 77 are fastened to the body housing 2, by the single nut 81 being screwed (threadedly engaged with) and fixed to the motor shaft 45. The partition plates 71 and the flow-guide members 73, 75 may, however, be fixed to the body housing 2, independently of the fans 6. In this case, the spacers 77 may be omitted. The method of fixing the partition plates 71 and the flow-guide members 73, 75 is not limited to fastening such as in the above-described embodiment. For example, in a case where the body housing 2 is formed by two halves that are divided along a plane that is parallel to the rotational axis A1, the partition plates 71 may be integrally formed with the body housing 2, and the flow-guide members 73, 75 may be held by ribs formed on the inside of the body housing 2.

The structure of the body housing 2 and the arrangement of the elements within the body housing 2 can be appropriately changed. For example, the shape of the body housing 2 (the tubular part 21) is not limited to the circular cylindrical shape, but may be changed to another shape such as a rectangular cylinder shape. The size, shape and arrangement of the inlet openings 201 and the discharge opening 203 may be appropriately changed from those of the above-described embodiment. The motor 4 may be disposed not between the inlet openings 201 and the fan 6 of the first stage, but between the fan 6 of the final stage and the discharge opening 203. The structure of the handle 3 can also be appropriately changed. In place of the handle 3, a portion of the body housing 2 may form a grip part to be held by a user.

In the above-described embodiment, the rotational speed of the motor 4 can be steplessly changed according to the manipulation amount of the trigger 311, but may be unchangeable from a predetermined speed or may be changeable in multiple steps. For example, the air duster 1 may be configured such that the rotational speed of the motor 4 can be set in multiple steps by manipulating the manipulation part 333 (the push buttons). In this case, the controller 331 may control the rotational speed of the motor 4 in response to a signal outputted from the manipulation part 333. The manipulation member via which a setting of the rotational speed of the motor 4 is inputted may be a dial or a touch panel, besides the trigger 311 or a push button. The controller 331 may be formed not by a microcomputer but by a control circuit of another kind.

The numerical values of the specifications (blowing force, nozzle diameter, fan diameter, maximum rotational speed, air volume, air velocity, pressure) described in the above embodiment is merely exemplary and other numerical values may be employed. The same applies for materials for the body housing 2, the fans 6, the partition plates 71, the flow-guide members 73, 75 and the spacers 77.

DESCRIPTION OF THE NUMERALS

1: air duster, 2: body housing, 201: inlet, 203: discharge opening, 21: cylindrical part, 211: rib, 212: front end surface, 23: front cover, 231: nozzle, 25: rear cover, 251: rib, 255: bearing-holding part, 256: retainer, 29: screw, 3: handle, 31: grip part, 311: trigger, 313: switch, 33: controller-housing part, 331: controller, 333: manipulation part, 34: battery mounting part, 340: battery, 4: motor, 40: body, 41: stator, 43: rotor, 431: balance ring, 45: motor shaft, 451: flange, 453: male thread part, 455: fan-mounting part, 46: bearing, 461: outer ring, 463: inner ring, 47: bearing, 471: outer ring, 473: inner ring, 6: fan, 601: first fan, 602: second fan, 603: third fan, 61: hub, 610: sleeve, 612: large-diameter part, 613: flange, 614: small-diameter part, 63: body, 631: back plate, 632: projection, 633: vane, 635: boss, 65: locking member, 651: boss, 653: flange, 654: recess, 7: partitioning structure, 71: partition plate, 710: air hole, 711: first partition plate, 712: second partition plate, 713: third partition plate, 73: flow-guide member, 731: base plate, 732: protruding part, 733: through hole, 735: guide vane, 75: flow-guide member, 751: cylindrical part, 753: guide vane, 755: bearing-holding part, 756: through hole, 77: spacer, 81: nut, 83: locking nut, 89: washer, R1: first region, R2: second region, R3: third region

What is claimed is:

1. A blower, comprising:

a brushless motor;

a plurality of fans coaxially arranged in multiple stages and configured to compress and blow air by rotating around a specified rotational axis when the brushless motor is driven;

a housing that houses the brushless motor and the fans, the housing having an inlet opening through which the air is sucked into the housing and a discharge opening through which the air compressed and blown by the fans is discharged; and a battery mounting part to which a battery for supplying power to the brushless motor is removably mountable, wherein:

a rotational speed of the brushless motor is within a range of 50,000 rpm to 120,000 rpm, a diameter of each of the fans is within a range of 30 mm to 50 mm, an area of the discharge opening is within a range of not less than an area of a circle having a diameter of 2.5 mm and not more than an area of a circle having a diameter of 10 mm, and a blowing force of the air discharged through the discharge opening is within a range of 1 N to 3 N.

2. The blower as defined in claim 1, wherein the fans are arranged in three stages.

3. The blower as defined in claim 1, wherein the area of the discharge opening is within a range of not less than an area of a circle having a diameter of 5 mm and not more than an area of a circle having a diameter of 10 mm.

4. The blower as defined in claim 1, wherein the rotational speed of the brushless motor is within a range of 50,000 rpm to 70,000 rpm.

5. The blower as defined in claim 1, wherein:

the blower further comprises:

a manipulation member configured to be externally manipulated by a user, and a control device configured to control rotational speed of the brushless motor in response to manipulation of the manipulation member.

6. The blower as defined in claim 1, wherein the blower is a handheld blower further comprising a grip part to be held by a user when used.

7. The blower as defined in claim 1, wherein:

each of the fans is a centrifugal fan, the blower further includes:

a plurality of partition plates respectively disposed on suction sides of the fans in a direction of the rotational axis and defining boundaries of regions corresponding to the fans, the partition plates each having a communication hole located on the rotational axis, and at least one flow-guide member disposed between the fans in the axial direction and configured to guide the air in a specific direction.

8. The blower as defined in claim 1, wherein:

the diameter of each of the fans is within a range of 30 mm to 50 mm, and the area of the discharge opening is within a range of not less than an area of a circle having a diameter of 5 mm and not more than an area of a circle having a diameter of 10 mm.

9. The blower as defined in claim 8, wherein the rotational speed of the brushless motor is within a range of 50,000 rpm to 70,000 rpm.

10. The blower as defined in claim 9, further comprising:

a manipulation member configured to be externally manipulated by a user, and a control device configured to control rotational speed of the brushless motor in response to manipulation of the manipulation member.

11. The blower as defined in claim 10, wherein the blower is a handheld blower further comprising a grip part to be held by a user when used.

12. The blower as defined in claim 11, further comprising:

a plurality of partition plates; and at least one flow-guide member, wherein:

each of the fans is a centrifugal fan, each of the fans includes (i) a disc-like back plate having a first surface on a suction side and a second surface on a side opposite to the first surface, and (ii) a plurality of vanes protruding from the first surface, the partition plates are respectively disposed on suction sides of the fans in a direction of the rotational axis to define boundaries of regions corresponding to the fans, each of the partition plates has a communication hole located on the rotational axis, and the at least one flow-guide member is each disposed between the fans in the axial direction, the at least one flow-guide member each includes (i) a disc-like base plate arranged to face the second surface of the back plate and having a third surface facing the second surface and a fourth surface on a side opposite to the third surface, and (ii) a plurality of guide vanes protruding from the base plate and configured to guide the air in a specific direction, all of the guide vanes are on the fourth surface of the base plate and configured to guide the air toward a communication hole of a partition plate corresponding to the centrifugal fan of a next stage, and the guide vanes are arranged such that a radially outer end portion of each of the guide vanes is inclined in a direction opposite to a rotation direction of the centrifugal fan.

13. A blower, comprising:

a motor;

a plurality of fans coaxially arranged in multiple stages and configured to compress and blow air by rotating around a specified rotational axis when the motor is driven;

a housing that houses the motor and the fans, the housing having an inlet opening through which the air is sucked into the housing and a discharge opening through which the air compressed and blown by the fans is discharged; and a battery mounting part to which a battery for supplying power to the motor is removably mountable, wherein:

a rotational speed of the motor is within a range of 50,000 rpm to 120,000 rpm, a diameter of each of the fans is within a range of 30 mm to 70 mm, an area of the discharge opening is within a range of not less than an area of a circle having a diameter of 2.5 mm and not more than an area of a circle having a diameter of 10 mm, a blowing force of the air discharged through the discharge opening is within a range of 1 N to 3 N, each of the fans is a centrifugal fan, the blower further includes:

a plurality of partition plates respectively disposed on suction sides of the fans in a direction of the rotational axis and defining boundaries of regions corresponding to the fans, the partition plates each having a communication hole located on the rotational axis, and at least one flow-guide member disposed between the fans in the axial direction and configured to guide the air in a specific direction, each of the fans includes:

a disc-like back plate having a first surface on a suction side and a second surface on a side opposite to the first surface, and a plurality of vanes protruding from the first surface, the at least one flow-guide member each includes:

a disc-like base plate arranged to face the second surface of the back plate and having a third surface facing the second surface and a fourth surface on a side opposite to the third surface, and a plurality of protrusions protruding from the base plate and configured to guide the air in a specific direction, and all of the plurality of protrusions are on the fourth surface of the base plate and configured as a plurality of guide vanes configured to guide the air toward a communication hole of a partition plate corresponding to the centrifugal fan of a next stage.

14. The blower as defined in claim 13, wherein the guide vanes are arranged such that a radially outer end portion of each of the guide vanes is inclined in a direction opposite to a rotation direction of the centrifugal fan.

* * * * *